US008139090B2

(12) United States Patent
Someya et al.

(10) Patent No.: US 8,139,090 B2
(45) Date of Patent: Mar. 20, 2012

(54) IMAGE PROCESSOR, IMAGE PROCESSING METHOD, AND IMAGE DISPLAY DEVICE

(75) Inventors: Jun Someya, Tokyo (JP); Noritaka Okuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 852 days.

(21) Appl. No.: 11/885,927

(22) PCT Filed: Jul. 26, 2005

(86) PCT No.: PCT/JP2005/013614

§ 371 (c)(1),
(2), (4) Date: Jan. 2, 2008

(87) PCT Pub. No.: WO2006/095460

PCT Pub. Date: Sep. 14, 2006

(65) Prior Publication Data

US 2008/0174612 A1 Jul. 24, 2008

(30) Foreign Application Priority Data

Mar. 10, 2005 (JP) ..... 2005-067148
Mar. 23, 2005 (JP) ..... 2005-084193

(51) Int. Cl.
*G09G 5/10* (2006.01)

(52) U.S. Cl. ..... 345/690; 345/89

(58) Field of Classification Search ..... 345/87–103, 345/204, 690

See application file for complete search history.

(56) References Cited

U.S. PATENT DOCUMENTS

| | | | | |
|---|---|---|---|---|
| 6,556,180 | B1 * | 4/2003 | Furuhashi et al. | 345/87 |
| 6,756,955 | B2 * | 6/2004 | Someya et al. | 345/88 |
| 6,791,525 | B2 * | 9/2004 | Matsumura et al. | 345/100 |
| 6,853,384 | B2 * | 2/2005 | Miyata et al. | 345/601 |
| 7,034,788 | B2 * | 4/2006 | Someya et al. | 345/89 |
| 7,277,076 | B2 * | 10/2007 | Shiomi et al. | 345/89 |
| 7,327,340 | B2 * | 2/2008 | Someya et al. | 345/89 |
| 7,403,183 | B2 * | 7/2008 | Someya | 345/98 |
| 7,436,382 | B2 * | 10/2008 | Okuda et al. | 345/89 |
| 7,508,366 | B2 * | 3/2009 | Shiomi et al. | 345/87 |
| 7,596,178 | B2 * | 9/2009 | Adachi et al. | 375/240.15 |
| 2002/0050965 | A1 * | 5/2002 | Oda et al. | 345/87 |
| 2003/0080983 | A1 | 5/2003 | Someya et al. | |
| 2003/0231158 | A1 * | 12/2003 | Someya et al. | 345/101 |
| 2004/0189565 | A1 | 9/2004 | Someya | |

FOREIGN PATENT DOCUMENTS

| | | | |
|---|---|---|---|
| JP | 4-288589 | A | 10/1992 |
| JP | 6-189232 | A | 7/1994 |
| JP | 2003-202845 | A | 7/2003 |
| JP | 2004-310012 | A | 11/2004 |

* cited by examiner

*Primary Examiner* — Ricardo L Osorio

(74) *Attorney, Agent, or Firm* — Birch, Stewart, Kolasch & Birch, LLP

(57) ABSTRACT

An image processing device and an image processing method according to the present invention, by dividing an image into a plurality of blocks, generates a control signal denoting a change in the image data, based on a result of comparing first encoded image data that is quantized from image data in each of the blocks based on representative values of the image data in each of the blocks with second encoded image data that is obtained by delaying the first encoded image data for a period equivalent to one frame, and generates one-frame-preceding image data by choosing on a pixel to pixel basis either the current-frame image data or second decoded image data that is obtained by decoding the second encoded image data, based on the control signal.

22 Claims, 25 Drawing Sheets

FIG. 3A

| | A | B | C | D |
|---|---|---|---|---|
| a | 0 | 59 | 60 | 120 |
| b | 0 | 59 | 60 | 120 |
| c | 0 | 59 | 60 | 120 |
| d | 0 | 59 | 60 | 120 |

image data Di0 preceding by one frame

FIG. 3B

La0=60 Lb0=120

Q0

| | | | |
|---|---|---|---|
| 0 | 1 | 2 | 3 |
| 0 | 1 | 2 | 3 |
| 0 | 1 | 2 | 3 |
| 0 | 1 | 2 | 3 |

encoded image data Da0

FIG. 3C

| | A | B | C | D |
|---|---|---|---|---|
| a | 0 | 40 | 80 | 120 |
| b | 0 | 40 | 80 | 120 |
| c | 0 | 40 | 80 | 120 |
| d | 0 | 40 | 80 | 120 |

decoded image data Db0

FIG. 3D

| | A | B | C | D |
|---|---|---|---|---|
| a | 0 | 59 | 60 | 120 |
| b | 0 | 60 | 60 | 120 |
| c | 0 | 59 | 60 | 120 |
| d | 0 | 59 | 60 | 120 |

image data Di1 preceding by one frame

FIG. 3E

La1=60 Lb1=120

Q1

| | | | |
|---|---|---|---|
| 0 | 1 | 2 | 3 |
| 0 | 2 | 2 | 3 |
| 0 | 1 | 2 | 3 |
| 0 | 1 | 2 | 3 |

encoded image data Da1

FIG. 3F

| | A | B | C | D |
|---|---|---|---|---|
| a | 0 | 40 | 80 | 120 |
| b | 0 | 80 | 80 | 120 |
| c | 0 | 40 | 80 | 120 |
| d | 0 | 40 | 80 | 120 |

decoded image data Db1

FIG. 3G

| | A | B | C | D |
|---|---|---|---|---|
| a | 0 | 0 | 0 | 0 |
| b | 0 | 1 | 0 | 0 |
| c | 0 | 0 | 0 | 0 |
| d | 0 | 0 | 0 | 0 |

actual variation

FIG. 3H

| | A | B | C | D |
|---|---|---|---|---|
| a | 0 | 0 | 0 | 0 |
| b | 0 | 40 | 0 | 0 |
| c | 0 | 0 | 0 | 0 |
| d | 0 | 0 | 0 | 0 |

variation Dv1

FIG. 3I

| | A | B | C | D |
|---|---|---|---|---|
| a | 0 | 0 | 0 | 0 |
| b | 0 | 39 | 0 | 0 |
| c | 0 | 0 | 0 | 0 |
| d | 0 | 0 | 0 | 0 |

error in variation

FIG. 3J

| | A | B | C | D |
|---|---|---|---|---|
| a | 0 | 0 | 0 | 0 |
| b | 0 | 0 | 0 | 0 |
| c | 0 | 0 | 0 | 0 |
| d | 0 | 0 | 0 | 0 |

control signal Dw1

FIG. 3K

| | A | B | C | D |
|---|---|---|---|---|
| a | 0 | 59 | 60 | 120 |
| b | 0 | 60 | 60 | 120 |
| c | 0 | 59 | 60 | 120 |
| d | 0 | 59 | 60 | 120 |

one-frame-preceding image data Dq0

FIG. 3L

| | A | B | C | D |
|---|---|---|---|---|
| a | 0 | 0 | 0 | 0 |
| b | 0 | 1 | 0 | 0 |
| c | 0 | 0 | 0 | 0 |
| d | 0 | 0 | 0 | 0 |

error between one-frame-preceding image data Dq0 and image data Di1

FIG. 4A

| | A | B | C | D |
|---|---|---|---|---|
| a | 0 | 0 | 59 | 60 |
| b | 0 | 0 | 59 | 60 |
| c | 0 | 0 | 59 | 60 |
| d | 0 | 0 | 59 | 60 |

image data Di0 preceding by one frame

FIG. 4B

La0=30 Lb0=60

Q0

| | | | |
|---|---|---|---|
| 0 | 0 | 3 | 3 |
| 0 | 0 | 3 | 3 |
| 0 | 0 | 3 | 3 |
| 0 | 0 | 3 | 3 |

encoded image data Da0

FIG. 4C

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

decoded image data Db0

FIG. 4D

| | A | B | C | D |
|---|---|---|---|---|
| a | 0 | 59 | 60 | 0 |
| b | 0 | 59 | 60 | 0 |
| c | 0 | 59 | 60 | 0 |
| d | 0 | 59 | 60 | 0 |

image data Di1 preceding by one frame

FIG. 4E

La1=30 Lb1=60

Q1

| | | | |
|---|---|---|---|
| 0 | 3 | 3 | 0 |
| 0 | 3 | 3 | 0 |
| 0 | 3 | 3 | 0 |
| 0 | 3 | 3 | 0 |

encoded image data Da1

FIG. 4F

| | A | B | C | D |
|---|---|---|---|---|
| a | 0 | 60 | 60 | 0 |
| b | 0 | 60 | 60 | 0 |
| c | 0 | 60 | 60 | 0 |
| d | 0 | 60 | 60 | 0 |

decoded image data Db1

FIG. 4G

| | A | B | C | D |
|---|---|---|---|---|
| a | 0 | 59 | 1 | -60 |
| b | 0 | 59 | 1 | -60 |
| c | 0 | 59 | 1 | -60 |
| d | 0 | 59 | 1 | -60 |

actual variation

FIG. 4H

| | A | B | C | D |
|---|---|---|---|---|
| a | 0 | 60 | 0 | -60 |
| b | 0 | 60 | 0 | -60 |
| c | 0 | 60 | 0 | -60 |
| d | 0 | 60 | 0 | 60 |

variation Dv1

FIG. 4I

| | A | B | C | D |
|---|---|---|---|---|
| a | 0 | 1 | -1 | 0 |
| b | 0 | 1 | -1 | 0 |
| c | 0 | 1 | -1 | 0 |
| d | 0 | 1 | -1 | 0 |

error in variation

FIG. 4J

| | A | B | C | D |
|---|---|---|---|---|
| a | 0 | 1 | 0 | 1 |
| b | 0 | 1 | 0 | 1 |
| c | 0 | 1 | 0 | 1 |
| d | 0 | 1 | 0 | 1 |

control signal Dw1

FIG. 4K

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

Di1 Db0 Di1 Db0 one-frame-preceding image data Dq0

FIG. 4L

| | A | B | C | D |
|---|---|---|---|---|
| a | 0 | 0 | 1 | 0 |
| b | 0 | 0 | 1 | 0 |
| c | 0 | 0 | 1 | 0 |
| d | 0 | 0 | 1 | 0 |

error between one-frame-preceding image data Dq0 and image data Di1

FIG. 5A

| | A | B | C | D |
|---|---|---|---|---|
| a | 0 | 0 | 59 | 60 |
| b | 0 | 0 | 59 | 60 |
| c | 0 | 0 | 59 | 60 |
| d | 0 | 0 | 59 | 60 |

image data Di0 preceding by one frame

FIG. 5B

La0=30 Lb0=60

Q0

| | | | |
|---|---|---|---|
| 0 | 0 | 3 | 3 |
| 0 | 0 | 3 | 3 |
| 0 | 0 | 3 | 3 |
| 0 | 0 | 3 | 3 |

encoded image data Da0

FIG. 5C

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

decoded image data Db0

FIG. 5D

| | A | B | C | D |
|---|---|---|---|---|
| a | 0 | 59 | 60 | 120 |
| b | 0 | 59 | 60 | 120 |
| c | 0 | 59 | 60 | 120 |
| d | 0 | 59 | 60 | 120 |

image data Di1 preceding by one frame

FIG. 5E

La1=60 Lb1=120

Q1

| | | | |
|---|---|---|---|
| 0 | 1 | 2 | 3 |
| 0 | 1 | 2 | 3 |
| 0 | 1 | 2 | 3 |
| 0 | 1 | 2 | 3 |

encoded image data Da1

FIG. 5F

| | A | B | C | D |
|---|---|---|---|---|
| a | 0 | 40 | 80 | 120 |
| b | 0 | 40 | 80 | 120 |
| c | 0 | 40 | 80 | 120 |
| d | 0 | 40 | 80 | 120 |

decoded image data Db1

FIG. 5G

| | A | B | C | D |
|---|---|---|---|---|
| a | 0 | 59 | 1 | 60 |
| b | 0 | 59 | 1 | 60 |
| c | 0 | 59 | 1 | 60 |
| d | 0 | 59 | 1 | 60 |

actual variation

FIG. 5H

| | A | B | C | D |
|---|---|---|---|---|
| a | 0 | 40 | 20 | 60 |
| b | 0 | 40 | 20 | 60 |
| c | 0 | 40 | 20 | 60 |
| d | 0 | 40 | 20 | 60 |

variation Dv1

FIG. 5I

| | A | B | C | D |
|---|---|---|---|---|
| a | 0 | 19 | 19 | 0 |
| b | 0 | 19 | 19 | 0 |
| c | 0 | 19 | 19 | 0 |
| d | 0 | 19 | 19 | 0 |

error in variation

FIG. 5J

| | A | B | C | D |
|---|---|---|---|---|
| a | 1 | 1 | 1 | 1 |
| b | 1 | 1 | 1 | 1 |
| c | 1 | 1 | 1 | 1 |
| d | 1 | 1 | 1 | 1 |

control signal Dw1

FIG. 5K

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

Di1 Db0 one-frame-preceding image data Dq0

FIG. 5L

| | A | B | C | D |
|---|---|---|---|---|
| a | 0 | 0 | 1 | 0 |
| b | 0 | 0 | 1 | 0 |
| c | 0 | 0 | 1 | 0 |
| d | 0 | 0 | 1 | 0 |

error between one-frame-preceding image data Dq0 and image data Di1

FIG. 16A

| | A | B | C | D |
|---|---|---|---|---|
| a | 0 | 59 | 60 | 120 |
| b | 0 | 59 | 60 | 120 |
| c | 0 | 59 | 60 | 120 |
| d | 0 | 59 | 60 | 120 |

image data Di0 preceding by one frame

FIG. 16B

La0=60 Lb0=120

Q0

| | | | |
|---|---|---|---|
| 0 | 1 | 2 | 3 |
| 0 | 1 | 2 | 3 |
| 0 | 1 | 2 | 3 |
| 0 | 1 | 2 | 3 |

encoded image data Da0

FIG. 16C

| | A | B | C | D |
|---|---|---|---|---|
| a | 0 | 40 | 80 | 120 |
| b | 0 | 40 | 80 | 120 |
| c | 0 | 40 | 80 | 120 |
| d | 0 | 40 | 80 | 120 |

decoded image data Db0

FIG. 16D

| | A | B | C | D |
|---|---|---|---|---|
| a | 0 | 59 | 60 | 120 |
| b | 0 | 60 | 60 | 120 |
| c | 0 | 59 | 60 | 120 |
| d | 0 | 59 | 60 | 120 |

image data Di1 preceding by one frame

FIG. 16E

La1=60 Lb1=120

Q1

| | | | |
|---|---|---|---|
| 0 | 1 | 2 | 3 |
| 0 | 2 | 2 | 3 |
| 0 | 1 | 2 | 3 |
| 0 | 1 | 2 | 3 |

encoded image data Da1

FIG. 16F

| | A | B | C | D |
|---|---|---|---|---|
| a | 0 | 0 | 0 | 0 |
| b | 0 | 1 | 0 | 0 |
| c | 0 | 0 | 0 | 0 |
| d | 0 | 0 | 0 | 0 |

actual variation

FIG. 16G

| | A | B | C | D |
|---|---|---|---|---|
| a | 0 | 0 | 0 | 0 |
| b | 0 | 0 | 0 | 0 |
| c | 0 | 0 | 0 | 0 |
| d | 0 | 0 | 0 | 0 |

control signal Dw1

FIG. 16H

| | A | B | C | D |
|---|---|---|---|---|
| a | 0 | 59 | 60 | 120 |
| b | 0 | 60 | 60 | 120 |
| c | 0 | 59 | 60 | 120 |
| d | 0 | 59 | 60 | 120 |

one-frame-preceding image data Dq0

FIG. 16I

| | A | B | C | D |
|---|---|---|---|---|
| a | 0 | 0 | 0 | 0 |
| b | 0 | 1 | 0 | 0 |
| c | 0 | 0 | 0 | 0 |
| d | 0 | 0 | 0 | 0 |

error between one-frame-preceding image data Dq0 and image data Di1

FIG. 17A

| | A | B | C | D |
|---|---|---|---|---|
| a | 0 | 0 | 59 | 60 |
| b | 0 | 0 | 59 | 60 |
| c | 0 | 0 | 59 | 60 |
| d | 0 | 0 | 59 | 60 |

image data Di0 preceding by one frame

FIG. 17B

La0=30 Lb0=60 Q0

| | | | |
|---|---|---|---|
| 0 | 0 | 3 | 3 |
| 0 | 0 | 3 | 3 |
| 0 | 0 | 3 | 3 |
| 0 | 0 | 3 | 3 |

encoded image data Da0

FIG. 17C

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

decoded image data Db0

FIG. 17D

| | A | B | C | D |
|---|---|---|---|---|
| a | 0 | 59 | 60 | 0 |
| b | 0 | 59 | 60 | 0 |
| c | 0 | 59 | 60 | 0 |
| d | 0 | 59 | 60 | 0 |

image data Di1 preceding by one frame

FIG. 17E

La1=30 Lb1=60 Q1

| | | | |
|---|---|---|---|
| 0 | 3 | 3 | 0 |
| 0 | 3 | 3 | 0 |
| 0 | 3 | 3 | 0 |
| 0 | 3 | 3 | 0 |

encoded image data Da1

FIG. 17F

| | A | B | C | D |
|---|---|---|---|---|
| a | 0 | 59 | 1 | -60 |
| b | 0 | 59 | 1 | -60 |
| c | 0 | 59 | 1 | -60 |
| d | 0 | 59 | 1 | -60 |

actual variation

FIG. 17G

| | A | B | C | D |
|---|---|---|---|---|
| a | 0 | 1 | 0 | 1 |
| b | 0 | 1 | 0 | 1 |
| c | 0 | 1 | 0 | 1 |
| d | 0 | 1 | 0 | 1 |

control signal Dw1

FIG. 17H

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |
| | Di1 | Db0 | Di1 | Db0 |

one-frame-preceding image data Dq0

FIG. 17I

| | A | B | C | D |
|---|---|---|---|---|
| a | 0 | 0 | 1 | 0 |
| b | 0 | 0 | 1 | 0 |
| c | 0 | 0 | 1 | 0 |
| d | 0 | 0 | 1 | 0 |

error between one-frame-preceding image data Dqo and image data Di1

FIG. 18A

| | A | B | C | D |
|---|---|---|---|---|
| a | 0 | 0 | 59 | 60 |
| b | 0 | 0 | 59 | 60 |
| c | 0 | 0 | 59 | 60 |
| d | 0 | 0 | 59 | 60 |

image data Di0 preceding by one frame

FIG. 18B

La0=30 Lb0=60

Q0

| | | | |
|---|---|---|---|
| 0 | 0 | 3 | 3 |
| 0 | 0 | 3 | 3 |
| 0 | 0 | 3 | 3 |
| 0 | 0 | 3 | 3 |

encoded image data Da0

FIG. 18C

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

decoded image data Db0

FIG. 18D

| | A | B | C | D |
|---|---|---|---|---|
| a | 0 | 59 | 60 | 0 |
| b | 0 | 59 | 60 | 0 |
| c | 0 | 59 | 60 | 0 |
| d | 0 | 59 | 60 | 0 |

image data Di1 preceding by one frame

FIG. 18E

La1=30 Lb1=60

Q1

| | | | |
|---|---|---|---|
| 0 | 3 | 3 | 0 |
| 0 | 3 | 3 | 0 |
| 0 | 3 | 3 | 0 |
| 0 | 3 | 3 | 0 |

encoded image data Da1

FIG. 18F

| | A | B | C | D |
|---|---|---|---|---|
| a | 0 | 59 | 1 | -60 |
| b | 0 | 59 | 1 | -60 |
| c | 0 | 59 | 1 | -60 |
| d | 0 | 59 | 1 | -60 |

actual variation

FIG. 18G

| | A | B | C | D |
|---|---|---|---|---|
| a | 0 | 1 | 0 | 1 |
| b | 0 | 1 | 0 | 1 |
| c | 0 | 1 | 0 | 1 |
| d | 0 | 1 | 0 | 1 |

control signal Dw1

FIG. 18H

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |
| | Di1 | Db0 | Di1 | Db0 |

one-frame-preceding image data Dq0

FIG. 18I

| | A | B | C | D |
|---|---|---|---|---|
| a | 0 | 0 | 1 | 0 |
| b | 0 | 0 | 1 | 0 |
| c | 0 | 0 | 1 | 0 |
| d | 0 | 0 | 1 | 0 |

error between one-frame-preceding image data Dq0 and image data Di1

FIG. 21A

| | A | B | C | D |
|---|---|---|---|---|
| a | 0 | 59 | 60 | 120 |
| b | 0 | 59 | 60 | 120 |
| c | 0 | 59 | 60 | 120 |
| d | 0 | 59 | 60 | 120 |

image data Di0 preceding by one frame

FIG. 21B

La=60 Lb=120 Q0

| | | | |
|---|---|---|---|
| 0 | 1 | 2 | 3 |
| 0 | 1 | 2 | 3 |
| 0 | 1 | 2 | 3 |
| 0 | 1 | 2 | 3 |

encoded image data Da0

FIG. 21C

| | A | B | C | D |
|---|---|---|---|---|
| a | 0 | 40 | 80 | 120 |
| b | 0 | 40 | 80 | 120 |
| c | 0 | 40 | 80 | 120 |
| d | 0 | 40 | 80 | 120 |

decoded image data Db0

FIG. 21D

| | A | B | C | D |
|---|---|---|---|---|
| a | 0 | 59 | 60 | 120 |
| b | 0 | 60 | 60 | 120 |
| c | 0 | 59 | 60 | 120 |
| d | 0 | 59 | 60 | 120 |

image data Di1 preceding by one frame

FIG. 21E

La=60 Lb=120 Q1

| | | | |
|---|---|---|---|
| 0 | 1 | 2 | 3 |
| 0 | 2 | 2 | 3 |
| 0 | 1 | 2 | 3 |
| 0 | 1 | 2 | 3 |

encoded image data Da1

FIG. 21F

| | A | B | C | D |
|---|---|---|---|---|
| a | 0 | 40 | 80 | 120 |
| b | 0 | 80 | 80 | 120 |
| c | 0 | 40 | 80 | 120 |
| d | 0 | 40 | 80 | 120 |

decoded image data Db1

FIG. 21G

| | A | B | C | D |
|---|---|---|---|---|
| a | 0 | 0 | 0 | 0 |
| b | 0 | 1 | 0 | 0 |
| c | 0 | 0 | 0 | 0 |
| d | 0 | 0 | 0 | 0 |

actual variation

FIG. 21H

| | A | B | C | D |
|---|---|---|---|---|
| a | 0 | 0 | 0 | 0 |
| b | 0 | 40 | 0 | 0 |
| c | 0 | 0 | 0 | 0 |
| d | 0 | 0 | 0 | 0 |

variation Dv1

FIG. 21I

| | A | B | C | D |
|---|---|---|---|---|
| a | 0 | 19 | 20 | 0 |
| b | 0 | 20 | 20 | 0 |
| c | 0 | 19 | 20 | 0 |
| d | 0 | 19 | 20 | 0 |

error amount De1

FIG. 21J

| | A | B | C | D |
|---|---|---|---|---|
| a | 0 | 59 | 60 | 120 |
| b | 0 | 60 | 60 | 120 |
| c | 0 | 59 | 60 | 120 |
| d | 0 | 59 | 60 | 120 |

one-frame-preceding image data Dq0

FIG. 21K

| | A | B | C | D |
|---|---|---|---|---|
| a | 0 | 0 | 0 | 0 |
| b | 0 | 1 | 0 | 0 |
| c | 0 | 0 | 0 | 0 |
| d | 0 | 0 | 0 | 0 |

error between one-frame-preceding image data Dq0 and image data Di1 gray-scale value
120
60
59
0
100
60
20
3
2
1
0
120
80
40
0
error in the pixel of value 60
error in the pixel of value 59

Image data Di0 and Di1
quantized threshold value
quantized value
decoded image data Db0 and Db1

FIG. 23A

| | A | B | C | D |
|---|---|---|---|---|
| a | 0 | 0 | 59 | 60 |
| b | 0 | 0 | 59 | 60 |
| c | 0 | 0 | 59 | 60 |
| d | 0 | 0 | 59 | 60 |

image data Di0 preceding by one frame

FIG. 23B

La0=30 Lb0=60 Q0

| | | | |
|---|---|---|---|
| 0 | 0 | 3 | 3 |
| 0 | 0 | 3 | 3 |
| 0 | 0 | 3 | 3 |
| 0 | 0 | 3 | 3 |

encoded image data Da0

FIG. 23C

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

decoded image data Db0

FIG. 23D

| | A | B | C | D |
|---|---|---|---|---|
| a | 0 | 59 | 60 | 0 |
| b | 0 | 59 | 60 | 0 |
| c | 0 | 59 | 60 | 0 |
| d | 0 | 59 | 60 | 0 |

image data Di1 receding by one frame

FIG. 23E

La0=30 Lb0=60 Q1

| | | | |
|---|---|---|---|
| 0 | 3 | 3 | 0 |
| 0 | 3 | 3 | 0 |
| 0 | 3 | 3 | 0 |
| 0 | 3 | 3 | 0 |

encoded image data Da1

FIG. 23F

| | A | B | C | D |
|---|---|---|---|---|
| a | 0 | 60 | 60 | 0 |
| b | 0 | 60 | 60 | 0 |
| c | 0 | 60 | 60 | 0 |
| d | 0 | 60 | 60 | 0 |

decoded image data Db1

FIG. 23G

| | A | B | C | D |
|---|---|---|---|---|
| a | 0 | 59 | 1 | -60 |
| b | 0 | 59 | 1 | -60 |
| c | 0 | 59 | 1 | -60 |
| d | 0 | 59 | 1 | -60 |

actual variation

FIG. 23H

| | A | B | C | D |
|---|---|---|---|---|
| a | 0 | 60 | 0 | 60 |
| b | 0 | 60 | 0 | 60 |
| c | 0 | 60 | 0 | 60 |
| d | 0 | 60 | 0 | 60 |

variation Dv1

FIG. 23I

| | A | B | C | D |
|---|---|---|---|---|
| a | 0 | 1 | 0 | 0 |
| b | 0 | 1 | 0 | 0 |
| c | 0 | 1 | 0 | 0 |
| d | 0 | 1 | 0 | 0 |

error amount De1

FIG. 23J

| | A | B | C | D |
|---|---|---|---|---|
| a | 0 | 0 | 60 | 60 |
| b | 0 | 0 | 60 | 60 |
| c | 0 | 0 | 60 | 60 |
| d | 0 | 0 | 60 | 60 |

Di1 Db0 Di1 Db0 one-frame-preceding image data Dq0

FIG. 23K

| | A | B | C | D |
|---|---|---|---|---|
| a | 0 | 0 | 1 | 0 |
| b | 0 | 0 | 1 | 0 |
| c | 0 | 0 | 1 | 0 |
| d | 0 | 0 | 1 | 0 |

error between one-frame-preceding image data Dq0 and image data Di1

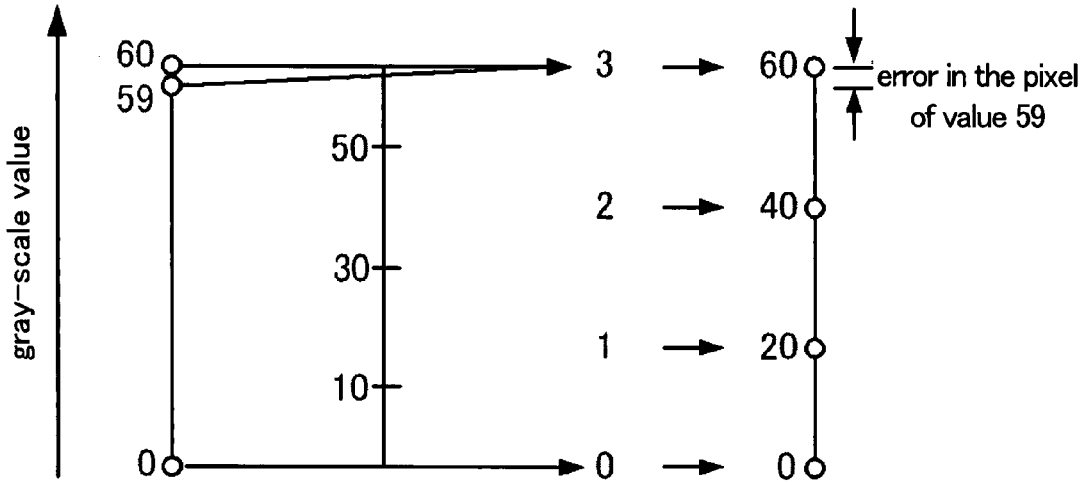
FIG. 24A image data Da0 and Da1
FIG. 24B quantized threshold value
FIG. 24C quantized value
FIG. 24D decoded image data Db0 and Db1

IMAGE PROCESSOR, IMAGE PROCESSING METHOD, AND IMAGE DISPLAY DEVICE

FIELD OF THE INVENTION

The present invention relates mainly to image processors and image processing methods for improving response speed of liquid crystal displays and the like.

BACKGROUND OF THE INVENTION

Liquid crystal panels, by reason of their small thickness and lightweight, have been widely used for display devices such as a television receiver, a display device for a computer, and a display section of a personal digital assistant. Since liquid crystals, however, take a certain time to reach a designated transmittance after the driving voltage is applied thereto, there has been a shortcoming in that the liquid crystals cannot respond to motion images changing quickly. In order to solve such a problem, a driving method is employed in which an overvoltage is applied to a liquid crystal so that the liquid crystal reaches a designated transmittance within one frame in a case of gray-scale values varying frame by frame (Japanese Patent Publication No. 2616652). To be more specific, comparing on a pixel to pixel basis current-frame image data with image data preceding by one frame, if a gray-scale value varies, a compensation value corresponding to the variation is added to the current-frame image data. That is, if a gray-scale value increases with respect to that preceding by one frame, a driving voltage higher than usual is applied to the liquid crystal panel, and if decreases, a voltage lower than usual is applied thereto.

In order to perform the method described above, a frame memory is required to output image data preceding by one frame. Recently, there has been a need for increasing capacity of a frame memory with increasing pixels to be displayed due to upsizing of liquid crystal panels. Moreover, since increase in the number of pixels to be displayed involves to increase the amount of data to be read from and written into a frame memory during a given period (for example, one frame period), a data transfer rate needs to be increased by increasing the clock frequency that controls the reading and writing. Such increase in capacity of frame memory and in the transfer rate leads to cost increase of liquid crystal display devices.

In order to solve such problems, the image processing circuit for driving a liquid crystal, disclosed in Japanese Laid-Open Patent Publication No. 2004-163842, reduces its frame memory capacity by encoding image data to be stored therein. By correcting image data based on a difference between decoded image data of a current frame obtained by decoding encoded image data and image data preceding by one frame obtained by decoding encoded image data delay by one frame period, unnecessary voltage caused by an encoding and decoding error, which occurs when a still image is inputted, can be prevented from being applied to the liquid crystal.

SUMMARY OF THE INVENTION

As for a motion image, a dither processing is performed that generates pseudo-halftones by controlling an interleaving rate of frames that are added with a gray-scale by one level in the least significant bit of the image data. In the image processing circuit for driving a liquid crystal, disclosed in Japanese Laid-Open Patent Publication No. 2004-163842, image data is corrected based on a difference between decoded image data of a current frame and a previous frame. In a case image data processed as described above is inputted, if an inter-frame change in the gray-scale by one level is amplified due to an encoding and decoding error, a variation of the image data, which is detected from decoded image data, becomes large. As a result, unnecessary compensation, which applies over-voltage to liquid crystals, occurs.

The present invention has been made in light of the above-described problems, with an object of providing an image processor for driving a liquid crystal that encodes and decodes image data to reduce size of a frame memory, that correct image data accurately without being affected by an encoding and decoding error, in order to apply an appropriate compensation voltage to a liquid crystal, even in cases that image data added with pseudo gray-scale signals are inputted.

A first image processor according to the present invention that corrects and outputs image data representing a gray-scale value of each of pixels of an image, based on a change in the gray-scale value of each pixel, the image processor includes, an encoding means that divides a current-frame image into a plurality of blocks, and outputs first encoded image data, corresponding to the current-frame image, configured including a representative value denoting a magnitude of pixel data of each of the blocks, and a quantized value, quantized based on the representative value, of pixel data in each of the blocks; a decoding means that decodes the first encoded image data, to output first decoded image data corresponding to the current-frame image; a delay means that delays the first encoded image data for a period equivalent to one frame, to output second encoded image data corresponding to the image preceding the current frame by one frame; a decoding means that decodes the second encoded image data, to output second decoded image data corresponding to the image preceding the current frame by one frame; an encoded data discrimination means that, by referring to the first and the second encoded image data, calculates variations of the representative value and the quantized value between the current-frame image and the image preceding by one frame, to generate, based on these variations, a control signal denoting a change in the pixel data of the current frame in each of the blocks; a one-frame-preceding-image calculation means that generates one-frame-preceding image data by choosing on a pixel to pixel basis, based on the control signal, either the current-frame image data or the second decoded image data; and an image data compensation means that compensates a gray-scale value of the current-frame image, based on the current-frame image data and the one-frame-preceding image data.

A second image processor according to the present invention that corrects and outputs image data representing a gray-scale value of each of pixels of an image, based on a change in the gray-scale value of the each pixel, the image processor includes an encoding means that encodes image data representing a current-frame image, to output the encoded image data corresponding to the current-frame image; a decoding means that decodes the encoded image data, to output first decoded image data corresponding to the current-frame image data; a delay means that delays the encoded image data for a period equivalent to one frame; a decoding means that decodes the encoded image data outputted from the delay means, to output second decoded image data corresponding to the image data preceding the current frame by one frame; a means that by calculating on a pixel to pixel basis a variation between the first and the second decoded image data and an error amount between the current-frame image data and the first decoded image data, generates one-frame-preceding image data by choosing on a pixel to pixel basis, based on the variation and the error amount, either the current-frame image data or the second decoded image data; and an image data compensation means that compensates a gray-scale value of the current-frame image, based on the current-frame image data and the one-frame-preceding image data.

According to the first image processor of the invention, by making reference to the first and the second encoded image data, variations of a representative value and a quantized value between a current-frame image and that preceding by one frame are calculated; a control signal that denotes a change in the current-frame pixel data in each of the blocks are generated based on these variations; based on the control signal, the one-frame-preceding image data is generated by choosing either the current-frame image data or the second decoded image data on a pixel to pixel basis. Therefore, an appropriate compensation voltage can be applied to the liquid crystal without being affected by an encoding and decoding error even in cases of image data being inputted that is added with a pseudo gray-scale signal.

According to the second image processor of the invention, a variation between the first and the second decoded image data, and an error amount between a current-frame image data and the first decoded image data are calculated on a pixel to pixel basis; the one-frame-preceding image data is generated by choosing on a pixel to pixel basis either the current-frame image data or the second decoded image data. Therefore, an appropriate compensation voltage can be applied to the liquid crystal without being affected by an encoding/decoding error even in cases of image data being inputted that are added with a pseudo gray-scale signal.

BRIEF DESCRIPTION OF DRAWINGS

FIG. 3 is diagrams for explaining processes of generating one-frame-preceding image data;

FIG. 4 is diagrams for explaining processes of generating one-frame-preceding image data;

FIG. 5 is diagrams for explaining processes of generating one-frame-preceding image data;

FIG. 16 is diagrams for explaining processes of generating one-frame-preceding image data;

FIG. 17 is diagrams for explaining processes of generating one-frame-preceding image data;

FIG. 18 is diagrams for explaining processes of generating one-frame-preceding image data;

FIG. 21 is diagrams for explaining processes of generating one-frame-preceding image data $D_{q0}$;

FIG. 23 is diagrams for explaining processes of generating the one-frame-preceding image data $D_{q0}$;

FIG. 24 is diagrams for explaining the encoding and decoding error;

DETAILED DESCRIPTION

Embodiment 1

Figure 1:
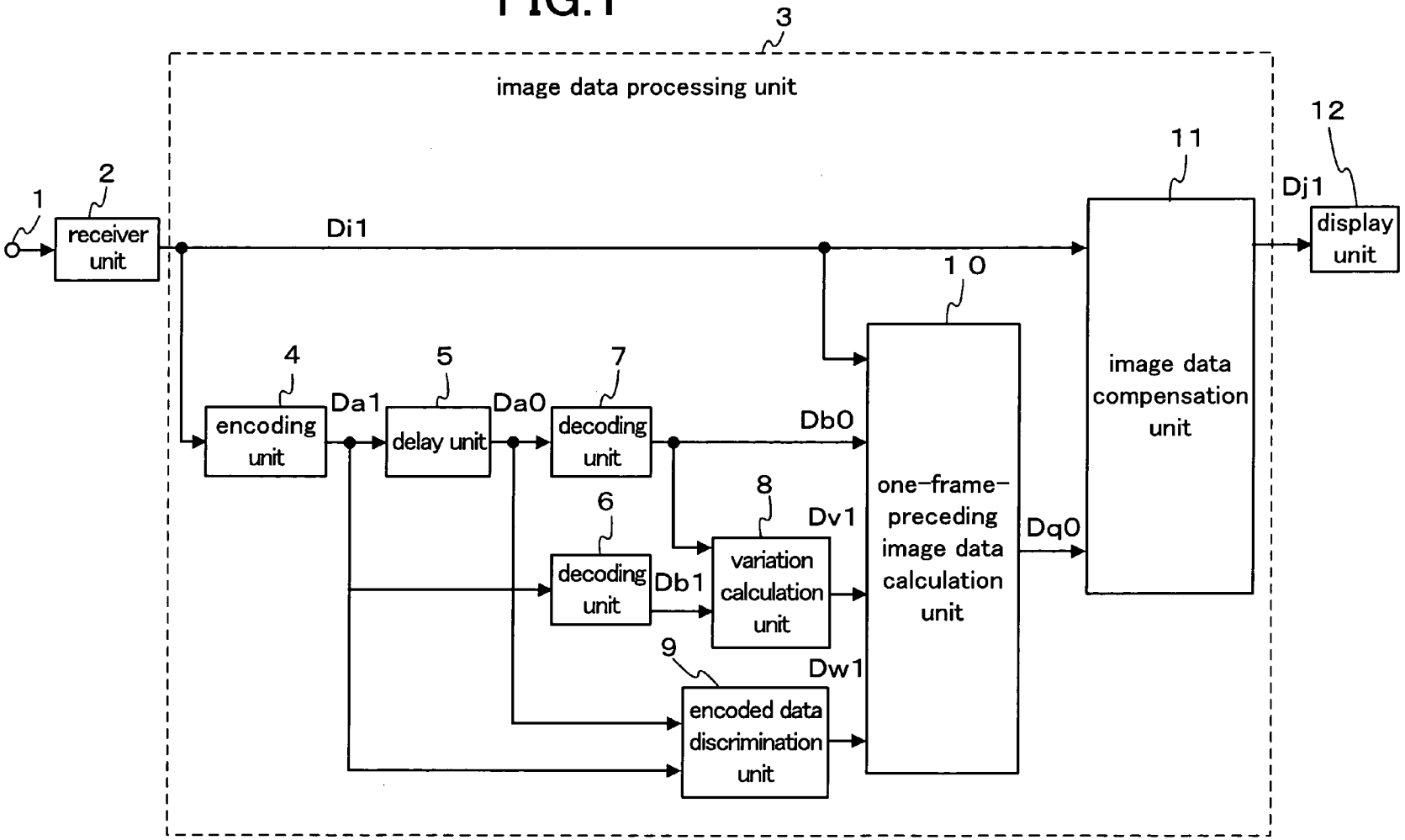
FIG. 1 is a block diagram illustrating an aspect of an image processor for driving a liquid crystal according to the present invention.

FIG. 1 is a block diagram illustrating a configuration of a liquid crystal display device provided with an image processor according to the present invention. A receiver unit 2 performs processes such as channel selection and demodulation of a video signal inputted through an input terminal 1, and successively outputs an image data $D_{i1}$ representing an image of one frame (a current-frame image) to an image data processing unit 3. The image data processing unit 3 is composed of an encoding unit 4, a delay unit 5, decoding units 6 and 7, a variation calculation unit 8, an encoded data discrimination unit 9, a one-frame-preceding-image calculation unit 10, and an image data compensation unit 11. The image data processing unit 3 corrects the image data $D_{i1}$ based on a change in the gray-scale value and output a compensated image data $D_{j1}$ to a display unit 12. The display unit 12 displays the image by applying to the liquid crystal predetermined driving voltages designated by the compensated image data $D_{j1}$.

An operation of the image data processing unit 3 will be explained bellow.

The encoding unit 4 encodes the image data $D_{i1}$ by using a block truncation coding (BTC) such as FBTC and GBTC, and output an encoded image data $D_{a1}$. The encoded image data $D_{a1}$ is generated by dividing the image data $D_{i1}$ into a plurality of blocks and quantizing image data in each of the blocks using quantizing thresholds, which is determined based on a representative value denoting magnitude of pixel data in each of the blocks. An averaged value $L_{a1}$ and a dynamic range $D_{a1}$ are used as the representative value. The encoded image data $D_{a1}$ consists of the averaged value $L_{a1}$, the dynamic range $L_{b1}$ of the image data in each of the blocks and a quantized value Q of each of the pixel data.

The delay unit 5 delays the encoded image data $D_{a1}$, for a period equivalent to one frame and output encoded image data $D_{a0}$ corresponding to the image preceding by one frame. Memory size of the delay unit 5, which is necessary for delaying the encoded image data $D_{a1}$, can be decreased by increasing an encoding rate (data compression rate) of the image data $D_{i1}$ in the encoding unit 4.

The decoding unit 6 decodes the encoded image data $D_{a1}$ and output decoded image data $D_{b1}$ corresponding to the image data $D_{i1}$. The decoding unit 7 decodes the encoded image data $D_{a0}$ and output decoded image data $D_{b0}$ corresponding to the image preceding by one frame.

The variation calculation unit 8 calculates difference between the decoded image data $D_{b1}$ of the current frame and the decoded image data $D_{b0}$ preceding by one frame on a pixel to pixel basis, and output absolute value of calculated difference in each pixel as variation $D_{v1}$. The variation $D_{v1}$ is inputted into the one-frame-preceding-image calculation unit 10 along with the image data $D_{i1}$ and the decoded image data $D_{b0}$.

The encoded data discrimination unit 9 receives the encoded image data $D_{a1}$ and $D_{a0}$ outputted from the encoding unit 4 and the delay unit 5, respectively. The encoded data discrimination unit 9 outputs a control signal $D_{w1}$ that denotes a motion or a still image region in the current-frame image based on a change in the encoded image data $D_{a1}$ from the encoded image data $D_{a0}$ preceding by one frame on a pixel to pixel basis. The control signal $D_{w1}=1$ is outputted for a pixel and block of which gray-scale value has varied from previous frame, and the control signal $D_{w1}=0$ is outputted for a pixel of which gray-scale value remain same or almost same.

The control signal $D_{w1}$ is determined by calculating $|L_{a1}-L_{a0}|$, a variation of the averaged values between current and previous frames in each block, and $|L_{b1}-L_{b0}|$, a variation of the dynamic ranges between current and previous frames in each block. In a case of these variations of each block exceeding predetermined thresholds ($T_{ha}$, $T_{hb}$), the control signal $D_{w1}=1$ is outputted for all pixels in the block. When the control signal $D_{w1}=1$ is outputted for all pixels in the block, the one-frame-preceding-image calculation unit 10 discriminates between a motion image and a still image on a pixel to pixel basis according to the variation $D_{v1}$ of each pixel. If the variation $D_{v1}$ exceeds the predetermined threshold ($T_{hv}$), an associated pixel is regarded as representing a motion image. On the other hand, if the variation $D_{v1}$ is equal to or smaller than the threshold, an associated pixel is regarded as representing a still image.

At the same time, if the variations $|L_{a1}-L_{a0}|$ and $|L_{b1}-L_{b0}|$ are equal to or smaller than the respective thresholds, discrimination between a motion and a still images is made based on a variation $|Q_1-Q_0|$ of quantized value $Q_1$ and $Q_0$ of each pixel. If $|Q_1-Q_0|$ is 1 or 0, associated pixel is regarded as representing a still image, and the control signal $D_{w1}=0$ is outputted. If $|Q_1-Q_0|$ exceeds 1, an associated pixel is regarded as representing a motion image, and the control signal $D_{w1}=1$ is outputted.

The control signal $D_{w1}$ outputted from the encoded data discrimination unit 9 is inputted into the one-frame-preceding-image calculation unit 10.

The one-frame-preceding-image calculation unit 10 generates one-frame-preceding image data $D_{q0}$ by selecting the image data $D_{i1}$ or the decoded image data $D_{b0}$ preceding by one frame on a pixel to pixel basis, based on a value of the control signal $D_{w1}$ and the variation $D_{v1}$. If the control signal $D_{w1}=0$, an associated pixel is regarded as representing a still image, and the image data $D_{i1}$ is selected for this pixel. If the control signal $D_{w1}=0$ and the variation $D_{v1}$ is smaller, an associated pixel is regarded as representing a still image, and the image data $D_{i1}$ is selected for this pixel. If the control signal $D_{w1}=1$ and the variation $D_{v1}$ is larger, an associated pixel is regarded as representing a motion image, and the decoded image data $D_{b0}$ is selected for this pixel. The one-frame-preceding image data $D_{q0}$ generated by selecting the image data $D_{i1}$ or the decoded image data $D_{b0}$ in a manner described above is inputted into the image data compensation unit 11.

Figure 2A:
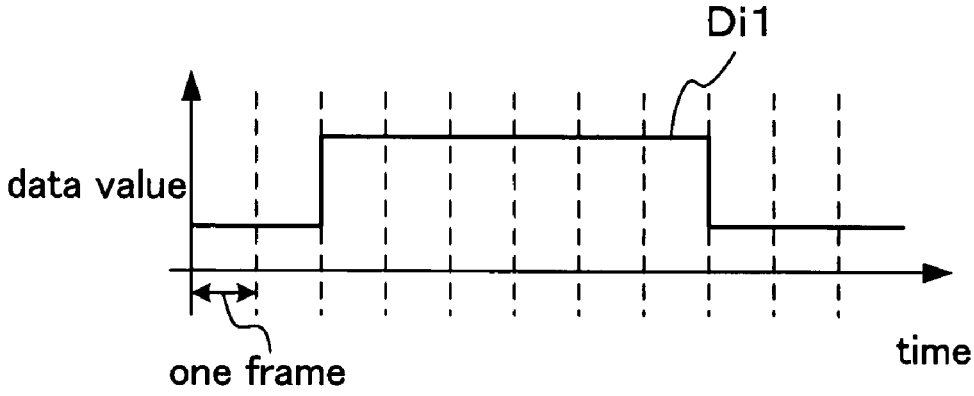
FIG. 2 is graphs illustrating response characteristics of a liquid crystal.
Figure 2B:
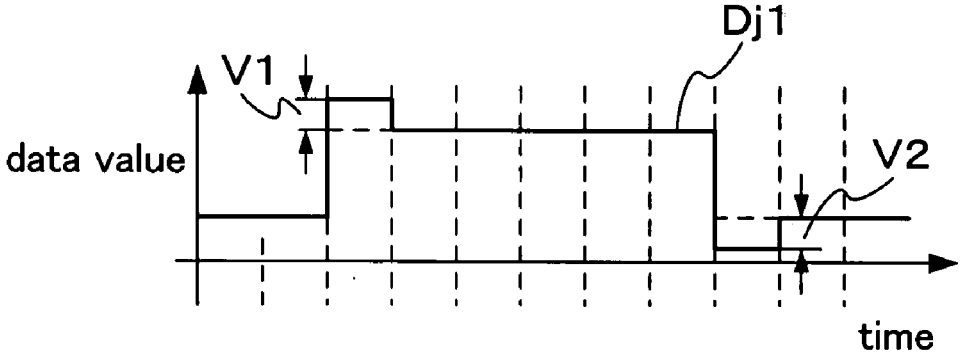
Figure 2C:
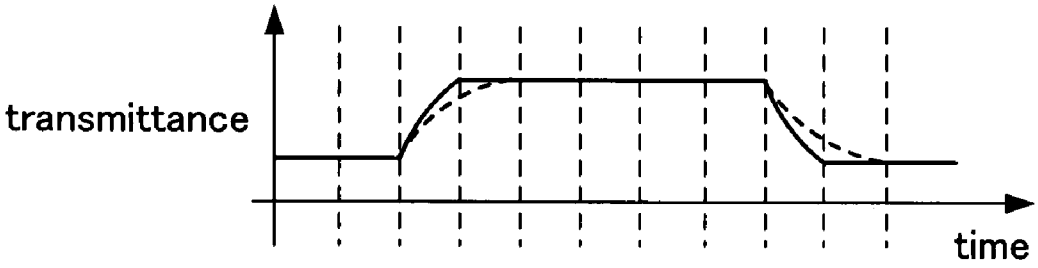

The image data compensation unit 11 compensates the image data $D_{i1}$ so that the liquid crystal reaches predetermined transmittances designated by the image data $D_{i1}$ within one frame period, based on inter-frame changes in gray-scale values obtained by comparing the image data $D_{i1}$ with the one-frame-preceding image data $D_q$, and output the compensated image data $D_{j1}$. FIG. 2 is graphs illustrating a response characteristic when a driving voltage based on the compensated image data $D_{j1}$ is applied to the liquid crystal. FIG. 2A is a graph illustrating the image data $D_{i1}$; FIG. 2B, a graph illustrating the compensated image data $D_{j1}$; and FIG. 2C is a graph illustrating a response characteristic of the liquid crystal obtained by applying a driving voltage based on the compensated image data $D_{j1}$. The broken line in FIG. 2C indicates a response characteristic of the liquid crystal when the driving voltage based on the image data $D_{i1}$ is applied. As shown in FIG. 2B, the compensated image data $D_{j1}$ is generated by adding compensation amount $V_1$ to image data $D_{i1}$, or subtracting $V_2$ from the image data $D_{i1}$. By applying the driving voltage based on the compensated image data $D_{j1}$, the liquid crystal can reach the predetermined transmittances designated by the image data $D_{i1}$ approximately within one frame period as shown in FIG. 2C.

FIG. 3 through FIG. 5 are diagrams for explaining processes of generating the one-frame-preceding image data $D_{q0}$ in the image data processing unit 3.

The processes of generating the one-frame-preceding image data $D_{q0}$ will be explained bellow in detail with reference to FIG. 3 through FIG. 5. In the following explanation, $T_{ha}$, $T_{hb}$, and $T_{hv}$ represents a threshold for respective variations $|L_{a1}-L_{a0}|$, $|L_{b1}-L_{b0}|$ and $D_{v1}$. These thresholds are $T_{ha}=10$, $T_{hb}=20$, and $T_{hv}=10$, in the following explanation.

FIG. 3 are diagrams for explaining the processes of generating the one-frame-preceding image data $D_{q0}$ in case that a still image added with pseudo gray-scale signals by a dither processing is inputted.

FIGS. 3D and 3A indicate values of the image data $D_{i1}$ of a current frame and image data $D_{q0}$ preceding by one frame, respectively. As shown in FIG. 3D, a pixel data (b, B) in the image data $D_{i1}$ of the current frame varies from 59 to 60 after being added with a pseudo gray-scale signal by the dither processing.

FIGS. 3B and 3E indicate the encoded data $D_{a0}$ and $D_{a1}$ corresponding to the image data $D_{i0}$ and $D_{i1}$ shown in FIGS. 3A and 3D, respectively. As shown in FIGS. 3B and 3E, the averaged values and the dynamic ranges of the image data $D_{i0}$ and $D_{i1}$ shown in FIGS. 3A and 3D are $L_{a0}=L_{a1}=60$ and $L_{b0}=L_{b1}=120$, respectively. The quantized values $Q_0$ and $Q_1$ are calculated by 2 bit quantization.

FIGS. 3C and 3F indicate the decoded image data $D_{b0}$ and $D_{b1}$ obtained by decoding the encoded image data $D_{a0}$ and $D_{a1}$ shown in FIGS. 3B and 3E, respectively.

FIG. 3G indicates a difference between the image data $D_{i0}$ and $D_{i1}$ shown in FIGS. 3A and 3D, an actual variation of the image. FIG. 3H indicates the variation $D_{v1}$, a difference between the decoded image data $D_{b0}$ and $D_{b1}$ shown in FIGS. 3C and 3F. The actual variation of the pixel data (b, B) is 1 as shown in FIG. 3G, however, the variation $D_{v1}$ of the same pixel is 40 as shown in FIG. 3H, due to an influence of error occurring in the encoding and decoding process.

FIG. 3I indicates an error between the actual variations shown in FIG. 3G and the variation $D_{v1}$ shown in FIG. 3H. From these diagrams, it is found that a large error occurs in the pixel data (b, B) where the pseudo gray-scale signal is added, due to the error in the encoding and decoding process.

FIG. 3J indicates the control signal $D_{w1}$ generated based on the encoded image data $D_{a0}$ and $D_{a1}$ shown in FIGS. 3B and 3E. As shown in FIGS. 3B and 3E, an averaged value variation between the current frame and the frame preceding by one frame $|L_{a1}-L_{a0}|=0$, and a dynamic range variation $|L_{b1}/L_{b0}|=0$, and both variations are smaller than the respective thresholds $T_{ha}=10$ and $T_{hb}=20$. A quantized value variation $|Q_1-Q_0|$ is 1 in the pixel (B, b) and 0 in the other pixels. Accordingly, the encoded data discrimination unit 9 outputs the control signal $D_{w1}=0$ for all pixels.

FIG. 3K indicates the one-frame-preceding image data $D_{q0}$ generated by selecting the decoded image data $D_{b0}$ shown in FIG. 3C or the image data $D_{i1}$ shown in FIG. 3D on a pixel to pixel basis, based on the variation $D_{v1}$ shown in FIG. 3H and the control signal $D_{w1}$ shown in FIG. 3J. While the variation $D_{v1}$ of the pixel data (b, B) exceeds the threshold $T_{hv}$ (=10) as shown in FIG. 3H, since the control signal $D_{w1}$ is 0 for all pixels as shown in FIG. 3J, the one-frame-preceding-image calculation unit 10 generates the one-frame-preceding image data $D_{q0}$ by selecting the image data $D_{i1}$ of the current frame for all pixels.

FIG. 3L indicates an error between the image data $D_{i0}$ preceding by one frame shown in FIG. 3A and the one-frame-preceding image data $D_{q0}$ shown in FIG. 3K. As shown in FIG. 3L, by selecting the image data $D_{i1}$ of the current frame as the image data preceding by one frame based on the control signal $D_{w1}$ and the variation $D_{v1}$, an encoding and decoding error due to the pseudo gray-scale signals can be corrected. In other words, changes in image data and the pseudo gray-scales are discriminated based on the averaged value variation $|L_{a1}-L_{a0}|$, the dynamic range variation $|L_{b1}-L_{b0}|$, and the quantized value variation $|Q_1-Q_0|$ of each of the blocks, which are included in the encoded image data $D_{a0}$ and $D_{a1}$, and in case that the pseudo gray-scales is recognized, the image data $D_{i1}$ of the current frame is selected as the image data preceding by one frame. As a result, the encoding and decoding error due to the dither processing can be prevented.

FIG. 4 are diagrams for explaining the operation of the image data processing unit 3 in case that a motion image is inputted.

FIGS. 4D and 4A indicate values of the image data $D_{i1}$ of a current frame and the image data $D_{i0}$ preceding by one frame, respectively. Comparing the image data $D_{i0}$ with the image data $D_{i1}$ shown in FIGS. 4A and 4D, pixel data in the B, C and D column vary from 0 to 59, 59 to 60, and 60 to 0, respectively.

FIGS. 4B and 4E indicate the encoded image data $D_{a0}$, and $D_{a1}$ corresponding to the image data $D_{i0}$ and $D_{i1}$ shown in FIGS. 4A and 4D, respectively. As shown in FIGS. 4B and 4E, the averaged values and the dynamic ranges of the image data $D_{i0}$ and $D_{i1}$ shown in FIGS. 4A and 4D are $L_{a0}=L_{a1}=30$ and $L_{b0}=L_{b1}=60$, respectively.

FIGS. 4C and 4F indicate the decoded image data $D_{b0}$ and $D_{b1}$ obtained by decoding the encoded image data $D_{a0}$ and $D_{a1}$ shown in FIGS. 4B and 4E, respectively.

FIG. 4G indicates differences between the image data $D_{i0}$ and $D_{i1}$ shown in FIGS. 4A and 4D, an actual variations of the image. FIG. 4H indicates the variation $D_{v1}$, a difference between the decoded image data $D_{b0}$ and $D_{b1}$ shown in FIGS. 4C and 4F.

FIG. 4I indicates an error between the actual variations shown in FIG. 4G and the variation $D_{v1}$ shown in FIG. 4H.

FIG. 4J indicates the control signal $D_{w1}$ generated based on the encoded image data $D_{a0}$, and $D_{a1}$ shown in FIGS. 4B and 4E. As shown in FIGS. 4B and 4E, the averaged value variation between the current frame and the frame preceding by one frame $|L_{a1}-L_{a0}=0$ and the dynamic range variation $|L_{b1}-L_{b0}=0$, and both variations are smaller than the respective thresholds $T_{ha}=10$ and $T_{hb}=20$. A quantized value variation $|Q_1-Q_0|=0$ in pixels in the A and C columns and $|Q_1-Q_0|=3$ in pixels in the B and D columns. Accordingly, the encoded data discrimination unit 9 outputs the control signal $D_{w1}=0$ for the pixels in the A and C columns and the control signal $D_{w1}=1$ for the pixels in the B and D columns.

FIG. 4K indicates the one-frame-preceding image data $D_{q0}$ generated by selecting the decoded image data $D_{b0}$ shown in FIG. 4C or the image data $D_{i1}$ shown in FIG. 4D on a pixel to pixel basis, based on the variation $D_{v1}$ shown in FIG. 4H and the control signal $D_{w1}$ shown in FIG. 4J. As shown in FIG. 4H, the variation $D_{v1}$ in pixels in the B and D columns is 60, exceeding the threshold $T_{hv}$ (=10). As shown in FIG. 4J, the control signal $D_{w1}$ in pixels in the A and C columns is 0 and 1 in pixels in the B and D columns. Accordingly, the one-frame-preceding-image calculation unit 10 generates the one-frame-preceding image data $D_{q0}$ by selecting the image data $D_{i1}$ of the current frame for the pixels in the A and C columns and selecting the decoded image data $D_{b0}$ for the pixels in the B and D columns.

FIG. 4L indicates an error between the image data $D_{i0}$ preceding by one frame shown in FIG. 4A and the one-frame-preceding image data $D_{q0}$ shown in FIG. 4K. As shown in FIG. 4L, by selecting the image data $D_{i1}$ of the current frame or the decoded image data $D_{b0}$ on a pixel to pixel basis, based on the control signal $D_{w1}$ and the variation $D_{v1}$, the one-frame-preceding image data $D_{q0}$ can be correctly generated. Furthermore, the error shown in FIG. 4L are smaller than those shown in FIG. 4I. This means the error in the variations between the one-frame-preceding image data $D_{q0}$ and the image data $D_{i0}$ are smaller than those in the variation $D_{v1}$ between the decoded image data $D_{b0}$ and $D_{b1}$.

FIG. 5 are diagrams for explaining the operation of the image data processing unit 3 in case that another motion image being inputted.

FIGS. 5D and 5A indicate values of the image data $D_{i1}$ of a current frame and the image data $D_{i0}$ preceding by one frame, respectively. Comparing the image data $D_{i0}$ with the image data $D_{i1}$ shown in FIGS. 5A and 5D, pixel data in the B, C and D columns varies from 0 to 59, 59 to 60, and 60 to 120.

FIGS. 5B and 5E indicate the encoded image data $D_{a0}$, and $D_{a1}$ corresponding to the image data $D_{i0}$ and $D_{i1}$ shown in FIGS. 5A and 5D, respectively. As shown in FIGS. 5B and 5E, the averaged values and the dynamic ranges of the image data $D_{i0}$ and $D_{i1}$ shown in FIGS. 5A and 5D are $L_{a0}=30$, $L_{a1}=60$, $L_{b0}=60$ and $L_{b1}=120$, respectively.

FIGS. 5C and 5F indicate the decoded image data $D_{b0}$ and $D_{b1}$ obtained by decoding the encoded image data $D_{a0}$ and $D_{a1}$ shown in FIGS. 5B and 5E, respectively.

FIG. 5G indicates a difference between the image data $D_{i0}$ and $D_{i1}$ shown in FIGS. 5A and 5D, an actual variation of the image. FIG. 5H indicates the variation $D_{v1}$, a difference between the decoded image data $D_{b0}$ and $D_{b1}$ shown in FIGS. 5C and 5F.

FIG. 5I indicates an error between the actual variations shown in FIG. 5G and the variation $D_{v1}$ shown in FIG. 5H.

FIG. 5J indicates the control signal $D_{w1}$ generated based on the encoded image data $D_{a0}$, and $D_{a1}$ shown in FIGS. 5B and 5E. As shown in FIGS. 5B and 5E, the averaged value variation between the current frame and the frame preceding by one frame $|L_{a1}-L_{a0}|=30$, and the dynamic range variation $|L_{b1}-L_{b0}|=60$, and both variations exceed the respective thresholds $T_{ha}=10$ and $T_{hb}=20$. Thus, the control signal $D_{w1}=1$ is outputted for all pixels in the block.

FIG. 5K indicates the one-frame-preceding image data $D_{q0}$ generated by selecting the decoded image data $D_{b0}$ shown in FIG. 5C or the image data $D_{i1}$ shown in FIG. 5D on a pixel to pixel basis, based on the variation $D_{v1}$ shown in FIG. 5H and the control signal $D_{w1}$ shown in FIG. 5J. As shown in FIG. 5H, the variation $D_{v1}$ of pixels in the B, C, and D columns are 40, 20, and 60, respectively, exceeding the threshold $T_{hv}$ (=10). As shown in FIG. 5J, the control signal $D_{w1}$ is 1 for all pixels. Accordingly, the one-frame-preceding-image calculation unit 10 generates the one-frame-preceding image data $D_{q0}$ by selecting the image data $D_{i1}$ of the current frame for pixels in the A column and selecting the decoded image data $D_{b0}$ for pixels in the B, C and D columns.

FIG. 5L indicates an error between the image data $D_{i0}$ preceding by one frame shown in FIG. 5A and the one-frame-preceding image data $D_{q0}$ shown in FIG. 5K. As shown in FIG. 5L, by selecting the image data $D_{i1}$ of the current frame or the decoded image data $D_{b0}$ based on the amount of the variation $D_{v1}$ when the averaged value variation $|L_{a1}-L_{a0}|$ and the dynamic range variation $|L_{b1}-L_{b0}-|$ of a block both exceed the respective predetermined thresholds ($T_{ha}$, $T_{hb}$), the one-frame-preceding image data $D_{q0}$ can be correctly generated with a small error.

As explained above with reference to FIG. 3 through FIG. 5, the averaged value variation $|L_{a1}-L_{a0}|$, the dynamic range variation $|L_{b1}-L_{b0}|$, and the quantized value variation $|Q_1-Q_0|$ is calculated from the encoded image data $D_{a0}$ and $D_{b1}$, and the control signal $D_{w1}$ for determining whether each pixel represents a motion or a still image is generated based on these variations. Then the decoded image data $D_{b0}$ or the image data $D_{i1}$ is selected on a pixel to pixel basis based on the control signal $D_{w1}$ and the variation $D_{v1}$, and the one-frame-preceding image data $D_{q0}$ is reproduced correctly. As a result, even in case that the image data $D_{i1}$ added with pseudo gray-scale signals are inputted, the appropriate compensation voltages are applied to the liquid crystal without affected by the encoding and decoding error.

To apply such encoding methods as JPEG, JPEG-LS, and JPEG2000, which converts image data into data in the frequency domain, in the encoding unit 4, a low frequency component is used as a representative value of a block. Those encoding methods for a still image are also applicable to an irreversible encoding whereby decoded image data is not in perfect agreement with the image data before encoded.

Figure 6:
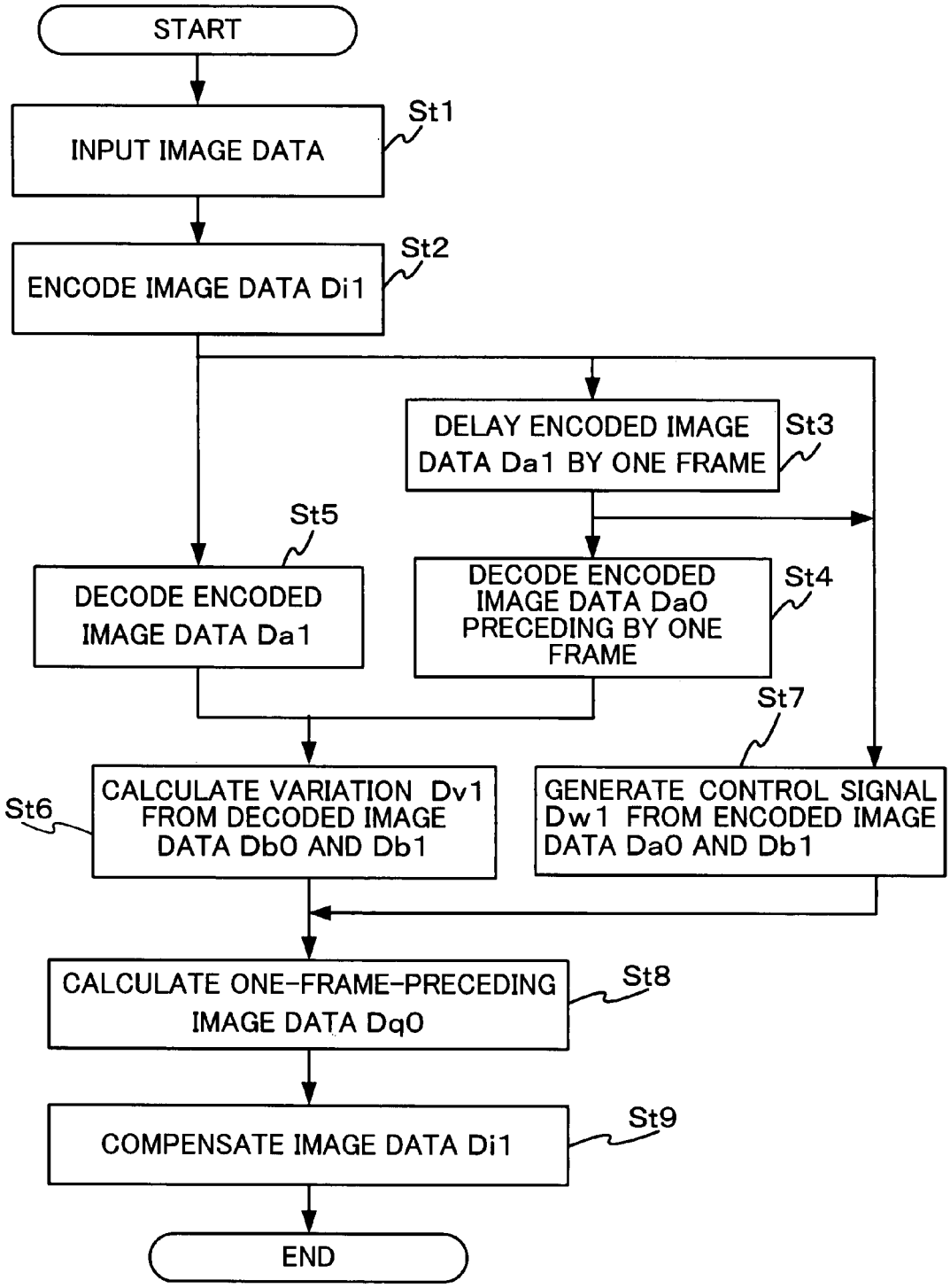
FIG. 6 is a flow chart illustrating an operation of the image processor for driving a liquid crystal according to the invention.

FIG. 6 is a block diagram illustrating the above-explained processing steps executed by the image data processing unit 3.

First, the image data $D_{i1}$ is inputted into the image data processing unit 3 (St1). The encoding unit 4 encodes the image data $D_{i1}$ inputted thereto, and output the encoded image data $D_{a1}$ (St2). The delay unit 5 delays the encoded image data $D_{a1}$ for one frame period, and output the encoded image data $D_{a0}$ preceding by one frame (St3). The decoding unit 7 decodes the encoded image data $D_{a0}$ preceding by one frame and outputs the decoded image data $D_{b0}$ corresponding to the image data $D_{i0}$ preceding by one frame (St4). In parallel with these processes, the decoding unit 6 decodes the encoded image data $D_{a1}$, and output the decoded image data $D_{b1}$ corresponding to the image data $D_{i1}$ of a current frame (St5).

The variation calculation unit 8 calculates a difference between the decoded image data $D_{b1}$ of the current frame and the decoded image data $D_{b0}$ preceding by one frame on a pixel to pixel basis, and output absolute values of the difference as the variation $D_{v1}$ (St6). In parallel with this process, the encoded data discrimination unit 9 compares the image data $D_{i1}$ of the current frame with the encoded image data $D_{a0}$ preceding by one frame, and in case that the variation $|L_{a1}-L_{a0}|$ and $|L_{b1}-L_{b0}|$ of a block exceed the respective predetermined thresholds ($T_{ha}$, $T_{hb}$), the control signal $D_{w1}=1$ is outputted for all pixels in this block. On the other hand, in case that the variations $|L_{a1}-L_{a0}|$ and $|L_{b1}-L_{b0}|$ are equal to or smaller than the respective thresholds, the control signal $D_{w1}=0$ is outputted for a pixel of which quantized value variation $|Q_1-Q_0|$ is 0 or 1, and the control signal $D_{w1}=1$ is outputted for a pixel of which variation $|Q_1-Q_0|$ is larger than 1 (St7).

The one-frame-preceding-image calculation unit 10 selects the decoded image data $D_{b0}$ for a pixel of which variations $D_{v1}$ is larger than the predetermined threshold ($T_{hv}$) and of which control signal $D_{w1}$ is 1, and selects the image data $D_{i1}$ as image data preceding by one frame for a pixel of which variation $D_{v1}$ is smaller than the predetermined threshold and of which control signals $D_{w1}$ is 0, and outputs the one-frame-preceding image data $D_{q0}$ (St8).

The image data compensation unit 11 calculates compensation amounts necessary for driving the liquid crystal to reach predetermined transmittances designated by the image data $D_{i1}$ within one frame period based on changes in gray-scale values obtained by comparing the one-frame-preceding image data $D_{q0}$ with the image data $D_{i1}$, and compensate the image data $D_{i1}$ using the compensation amounts, and outputs the compensated image data $D_{j1}$ (St9).

The processing steps St1 through St9 are executed for each pixel of the image data $D_{i1}$.

The one-frame-preceding image data $D_{q0}$ may be calculated by the following Formula (1):

$$D_{q0}=\min(k_1,k_2)\times D_{b0}+(1-\min(k_1,k_2))\times D_{i1} \quad (1).$$

In above Formula (1), $k_1$ and $k_2$ are variables between 0 and 1, of which values vary depending on values of the variation $D_{v1}$ and the control signal $D_{w1}$. $\min(k_1, k_2)$ represents a smaller value of $k_1$ and $k_2$.

Figure 7A:
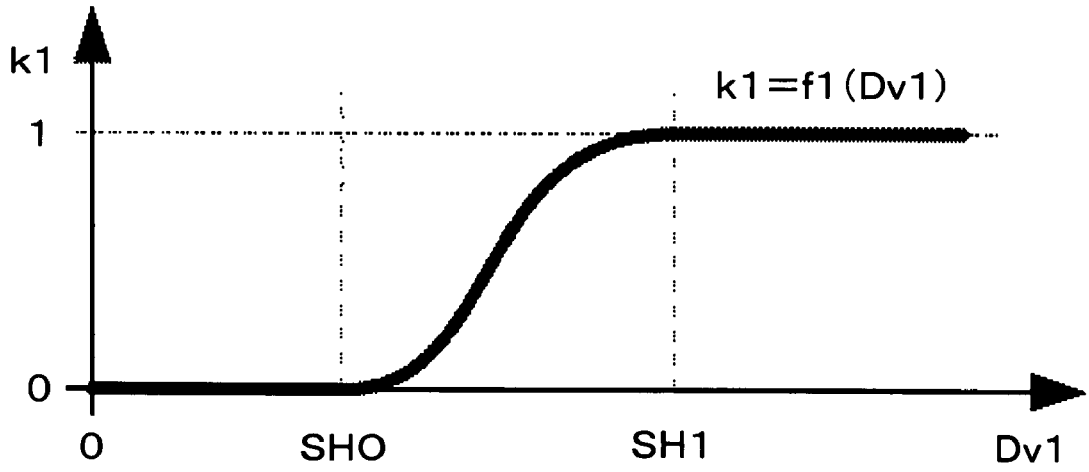
FIG. 7 is graphs illustrating characteristics of variables $k_1$ and $k_2$.
Figure 7B:
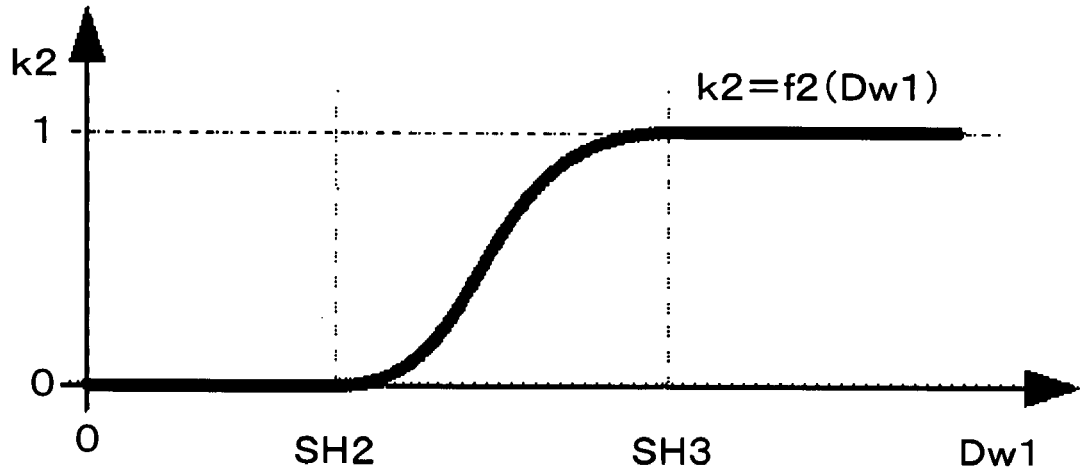

FIG. 7A and FIG. 7B are graphs illustrating relationships between the variation $D_{v1}$ and $k_1$, and the control signal $D_{w1}$ and $k_2$, respectively. As shown in FIG. 7A, two thresholds $SH_0$ and $SH_1$ ($SH_0<SH_1$) are set for the variation $D_{v1}$; $k_1=0$ when $D_{v1}<SH_0$, $0<k_1<1$ when $SH_0 \leqq D_{v1} \leqq SH_1$, and $k_1=1$ when $SH_1<D_{v1}$. As shown in FIG. 7B, two thresholds $SH_2$ and $SH_3$ ($SH_2<SH_3$) are also set for the control signal $D_{w1}$; $k_2=0$ when $D_{w1}<SH_2$, $0<k_2<1$ when $SH_2 \leqq D_{w1} \leqq SH_3$, and $k_2=1$ when $SH_3<D_{w1}$.

As shown in Formula (1), when either one of $k_1$ and $k_2$ is 0, the image data $D_{i1}$ is selected as the one-frame-preceding image data $D_{q0}$, and when both $k_1$ and $k_2$ are 1, the decoded image data $D_{b0}$ is outputted as the one-frame-preceding image data $D_{q0}$. In cases other than the above, weighted averages of the image data $D_{i1}$ and the decoded image data $D_{b0}$ are calculated as the one-frame-preceding image data $D_{q0}$ based on the smaller value of $k_1$ and $k_2$.

By using Formula (1), the one-frame-preceding image data $D_{q0}$ can be calculated with smaller an error even when the variation $D_{v1}$ and the control signal $D_{w1}$ are in the vicinity of respective thresholds.

The control signal $D_{w1}$ may be calculated by the following Formula (2):

$$D_{w1}=k_c\times(1-\max(k_a,k_b))+k_d\times\max(k_a,k_b) \quad (2).$$

In above Formula (2), $k_a$ and $k_b$ are variables between 0 and 1, of which values vary depending on values of $|L_{a1}-L_{a0}|$ and $|L_{b1}-L_{b0}|$, the variation of the averaged value and dynamic range. $k_c$ is a variable between 0 and 1, of which value varies depending on a value of $|Q_1-Q_0|$, variation of the quantized value. $k_d$ is a predetermined constant. $\max(k_a, k_b)$ represents a larger value of $k_a$ and $k_b$.

FIG. 8 are graphs illustrating each value of $k_a$, $k_b$, $k_c$, and $k_d$ in Formula (2).

Figure 8A:
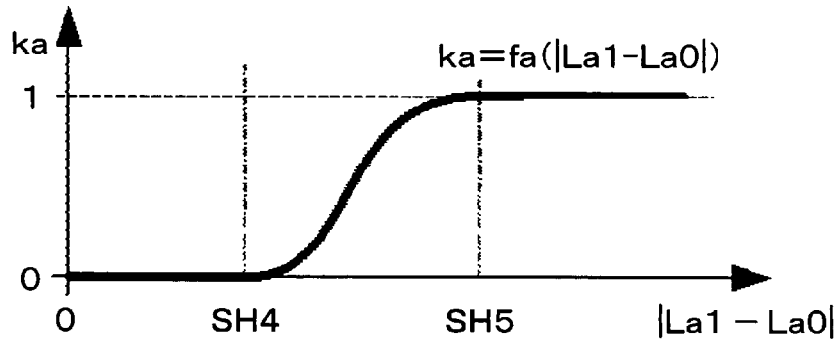
FIG. 8 is graphs illustrating characteristics of variables $k_a$, $k_b$, $k_c$, and $k_d$.

FIG. 8A is a graph illustrating a relationship between $|L_{a1}-L_{a0}|$ and $k_a$. As shown in FIG. 8A, two thresholds $SH_4$ and $SH_5$ ($SH_4<SH_5$) are set for $|L_{a1}-L_{a0}|$; $k_a=0$ when $|L_{a1}-L_{a0}|<SH_4$; $0<k_a<1$ when $SH_4 \leqq |L_{a1}-L_{a0}| \leqq SH_5$, and $k_a=1$ when $SH_5<|L_{a1}-L_{a0}|$.

Figure 8B:
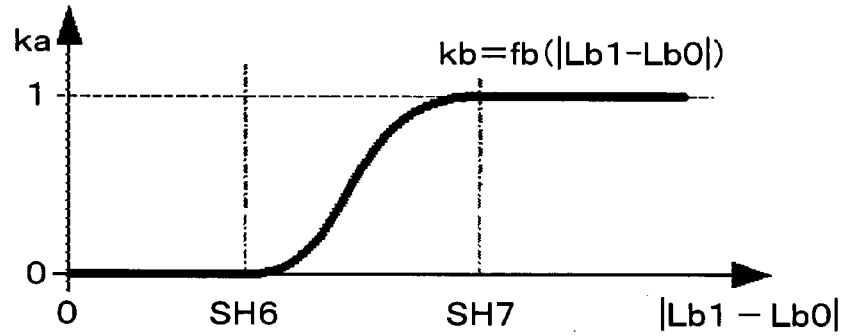

FIG. 8B is a graph illustrating a relationship between $|L_{b1}-L_{b0}|$ and $k_b$. As shown in FIG. 8B, two thresholds $SH_6$ and $SH_7$ ($SH_6<SH_7$) are set for $|L_{b1}-L_{b0}|$; $k_b=0$ when $|L_{b1}-L_{b0}|<SH_6$, $0<k_b<1$ when $SH_6 \leqq |L_{b1}-L_{b0}| \leqq SH_7$, and $k_b=0$ when $SH_7<|L_{b1}-L_{b0}|$.

Figure 8C:
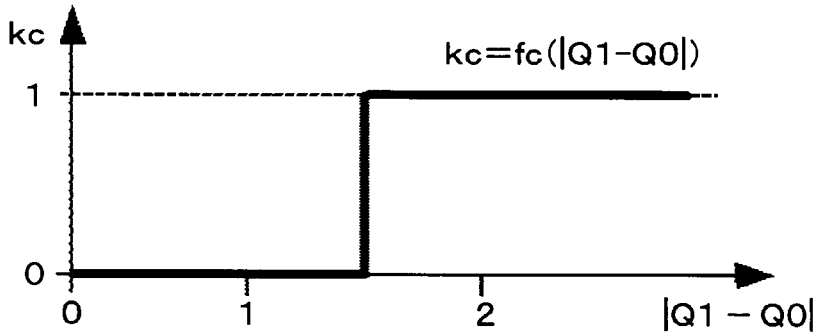
Figure 8D:
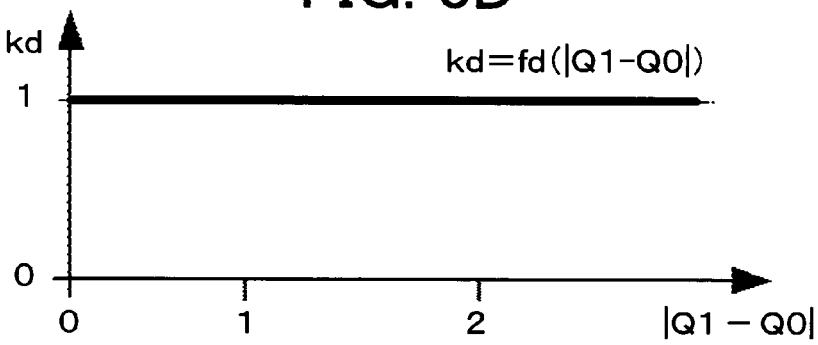

FIGS. 8C and 8D are graphs illustrating relationships between $|Q_1-Q_0|$ and $k_c$, and $|Q_1-Q_0|$ and $k_d$, respectively. The variable $k_c$ shown in FIG. 8C is used when associated block is a still image or a slow motion image, where $|L_{a1}-L_{a0}|$ is smaller than $SH_5$ and $|L_{b1}-L_{b0}|$ are smaller than $SH_7$. On the other hand, the variable $k_d$ (=1) shown in FIG. 8D is used when associated block is a motion image, where $|L_{a1}-L_{a0}|$ is equal to or larger than $SH_5$ or $|L_{b1}-L_{b0}|$ is equal to or larger than $SH_7$.

As shown in Formula (2), when both $k_a$ and $k_b$ are 0, $k_c$ with a characteristic shown in FIG. 8C is selected as the control signal $D_{w1}$, and when either one of $k_a$ and $k_b$ is 1, $k_d$ (=1) is selected as the control signal $D_{w1}$. In case other than the above, a weighted average of $k_c$ and $k_d$ is calculated as the control signal $D_{w1}$ based on a larger value of $k_a$ and $k_b$.

Embodiment 2

In Embodiment 1, the image data compensation unit 11 calculates compensation amounts based on changes in the gray-scale values obtained by comparing the one-frame-preceding image data $D_{q0}$ with the image data $D_{i0}$, and generate the compensated image data $D_{j1}$. As another example, the image data compensation unit 11 may be configured to compensate the image data $D_{i1}$ by referring to compensation amounts stored in a look-up table, and output the compensated image data $D_{j1}$.

Figure 9:
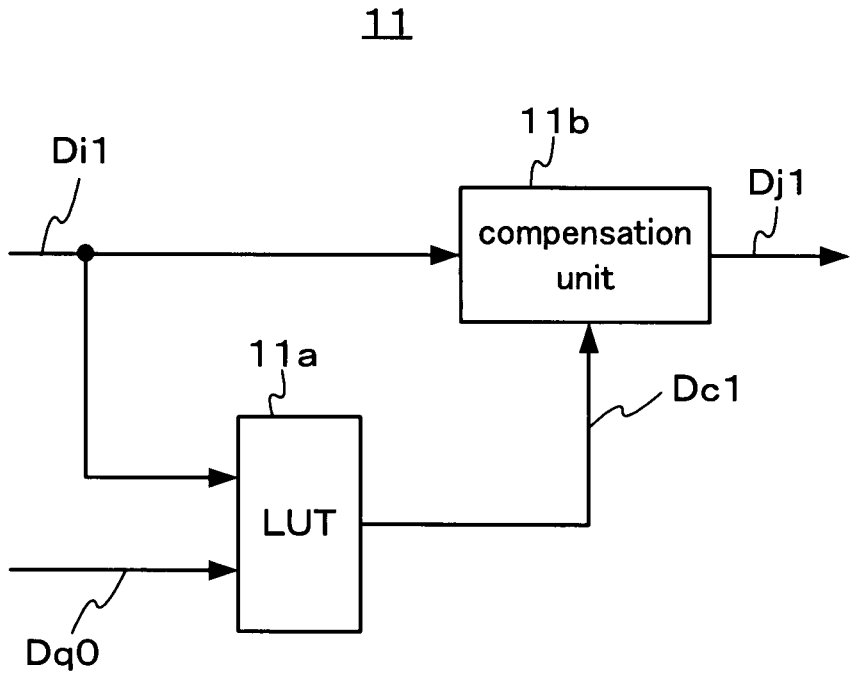
FIG. 9 a block diagram illustrating an example of an internal configuration of an image data compensation unit.

FIG. 9 is a block diagram illustrating an internal configuration of the image data compensation unit 11 according to Embodiment 2. A look-up table 11*a* receives the one-frame-preceding image data $D_{q0}$ and the image data $D_{i1}$ and outputs compensation amount $D_{c1}$ based on their values.

Figure 10:
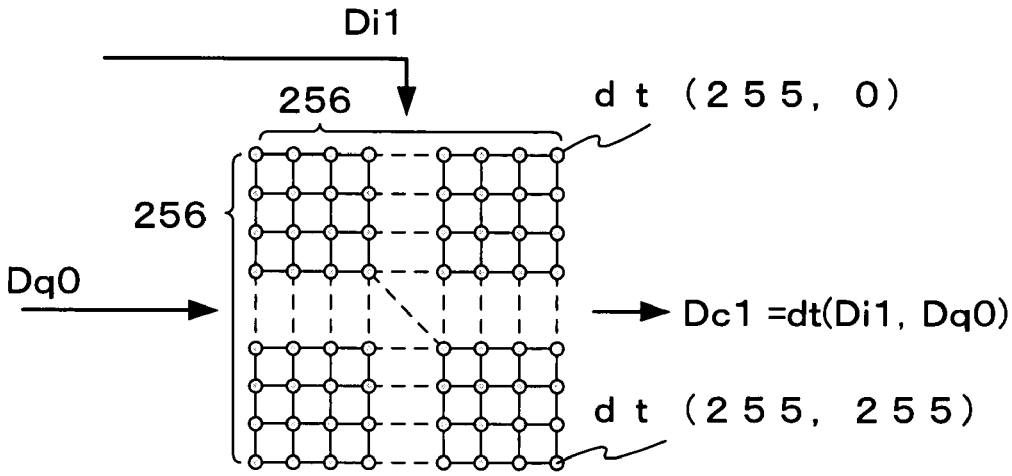
FIG. 10 is a schematic diagram illustrating a configuration of a look-up table.

FIG. 10 is a schematic diagram illustrating an example of a configuration of the look-up table 11*a*. The image data $D_{i1}$ and the one-frame-preceding image data $D_{q0}$ are inputted into the look-up table 11*a* as readout addresses. In case that the image data $D_{i1}$ and the one-frame-preceding image data $D_{q0}$ are represented by 8 bit data, 256×256 patterns of data are stored in the look-up table 11*a* as the compensation amount $D_{c1}$. The compensation amount $D_{c1}$ (=dt ($D_{i1}$, $D_{q0}$)) corresponding to a value of the image data $D_{i1}$ and the one-frame-preceding image data $D_{q0}$. are read and outputted from the look-up table 11*a*. A compensation section 11*b* adds the compensation amount $D_{c1}$ outputted from the look-up table 11*a* to the image data $D_{i1}$, and output the compensated image data $D_{j1}$.

Figure 11:
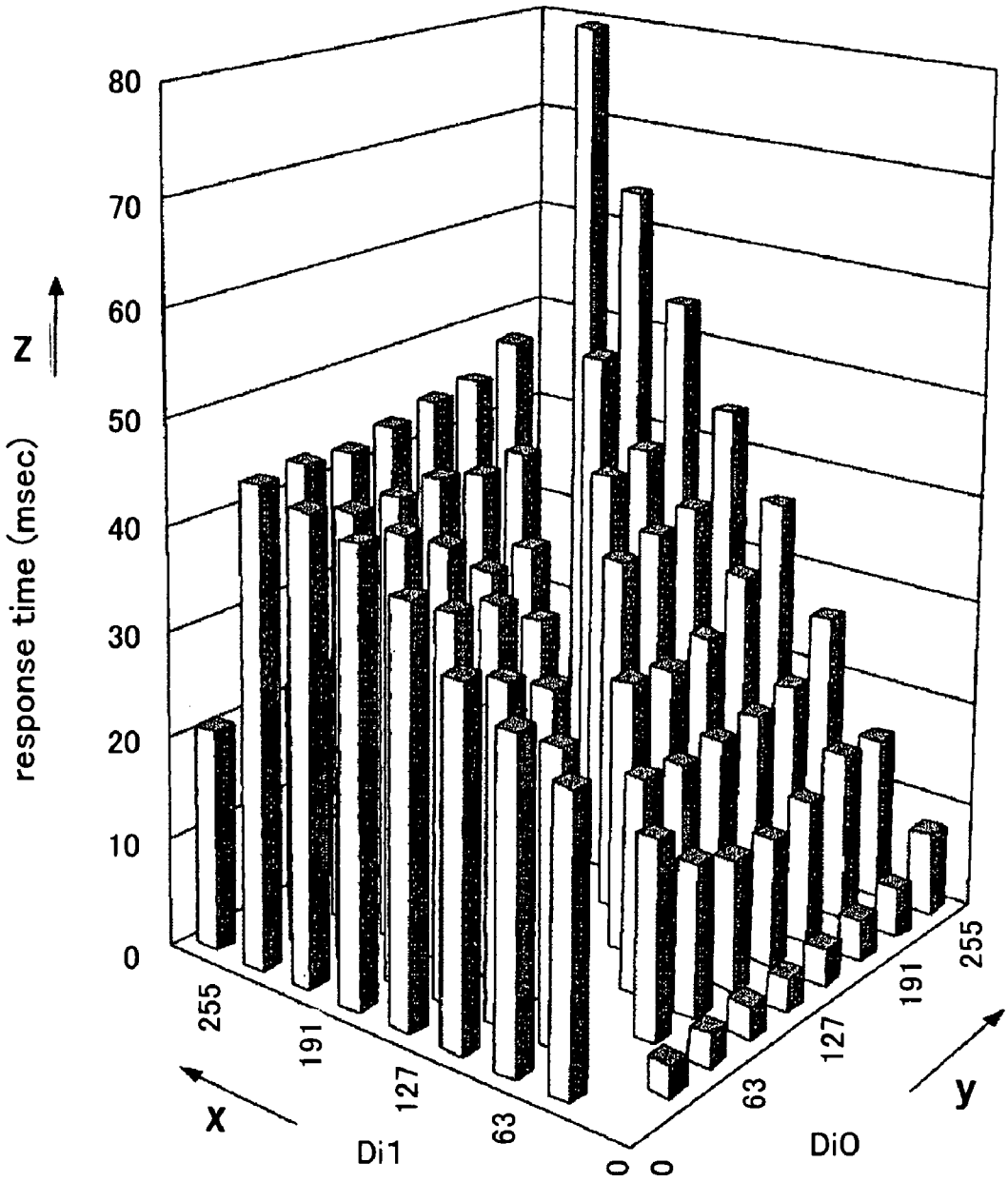
FIG. 11 is a histogram illustrating an example of response speed of the liquid crystal.

FIG. 11 is a diagram illustrating an example of response times of a liquid crystal. In FIG. 11, the x-axis denotes values of the image data $D_{i1}$ (gray-scale values of a current image), y-axis denotes values of the image data $D_{i0}$ preceding by one frame (gray-scale values of the image preceding by one frame), and z-axis denotes the response times required for the liquid crystal to reach transmittance corresponding to a gray-scale value of the image data $D_{i1}$ from transmittance corresponding to a gray-scale values of the preceding image data $D_{i0}$. In case that a gray-scale value of a current image is represented by 8 bit data, there are 256×256 patterns of the gray-scale value combinations of image data $D_{i0}$ and $D_{i1}$. Accordingly, there are 256×256 patterns of response times. The response time corresponding to the gray-scale-value combination are simplified into 8×8 cases in FIG. 11.

Figure 12:
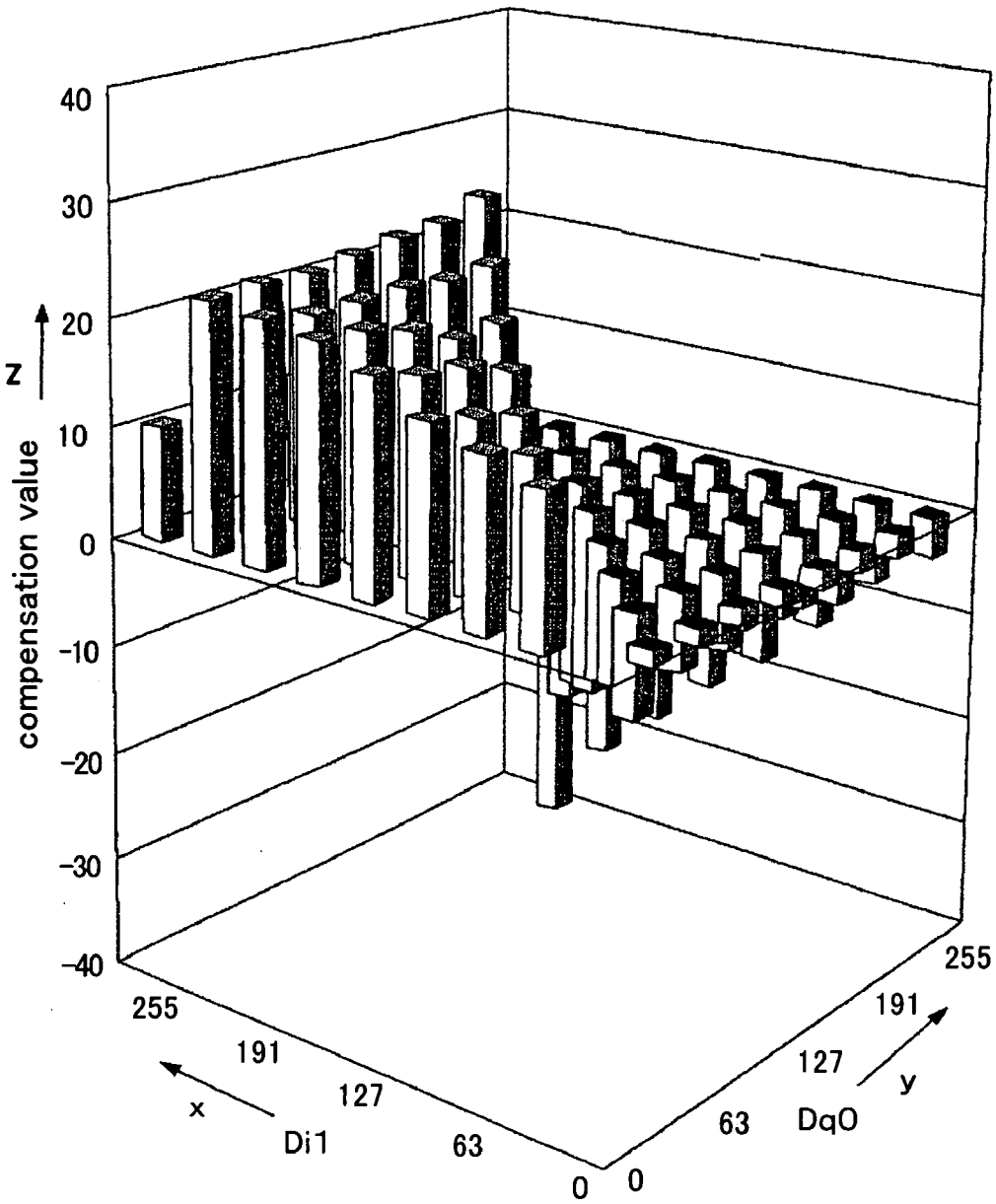
FIG. 12 is a histogram illustrating an example of compensation amounts stored in the look-up table.

FIG. 12 is a diagram illustrating values of the compensation amount $D_{a1}$ added to the image data $D_{i1}$ for the liquid crystal to have transmittances designated by the image data $D_{i1}$ within one frame period. When gray-scale values of image data are represented by 8 bit data, there are 256×256 patterns of the compensation amounts $D_{c1}$ in accordance with a gray-scale value combinations of image data $D_{i0}$ and $D_{i1}$. The compensation amounts corresponding to the gray-scale value combination are indicated in FIG. 12 simplified into 8×8 patterns.

Since the response times of the liquid crystal varies depending on gray-scale value differences between image data $D_{i0}$ and $D_{i1}$ as shown in FIG. 11, 256×256 patterns of the compensation amounts $D_{c1}$, which correspond to the gray-scale values of both the image data $D_{i0}$ and $D_{i1}$, are stored in the look-up table 11*a*. Liquid crystals have a slow response speed, in particular, varying from halftone (gray) to high-tone (white). (There are also cases of a slow response in a reverse or another variations depending on type of liquid crystal panel or on an operation mode.) Accordingly, by setting large values of the compensation amounts $D_{i1}$=dt ($D_{i1}$, $D_{q0}$) corresponding to the one-frame-preceding image data $D_{q0}$ representing halftone and the image data $D_{i1}$ representing high-tone, the response speed can be effectively improved. Moreover, since response characteristics of liquid crystal varies depending on its material, shape of the electrode, and temperature, the response time can be controlled depending on the characteristics of the liquid crystal by using the look-up table 11*a* provided with the compensation amount $D_{c1}$ corresponding to such conditions.

As described above, by using the look-up table 11*a* storing the predetermined compensation amount $D_{c1}$, calculation required to output the compensated image data $D_{j1}$ can be reduced.

Figure 13:
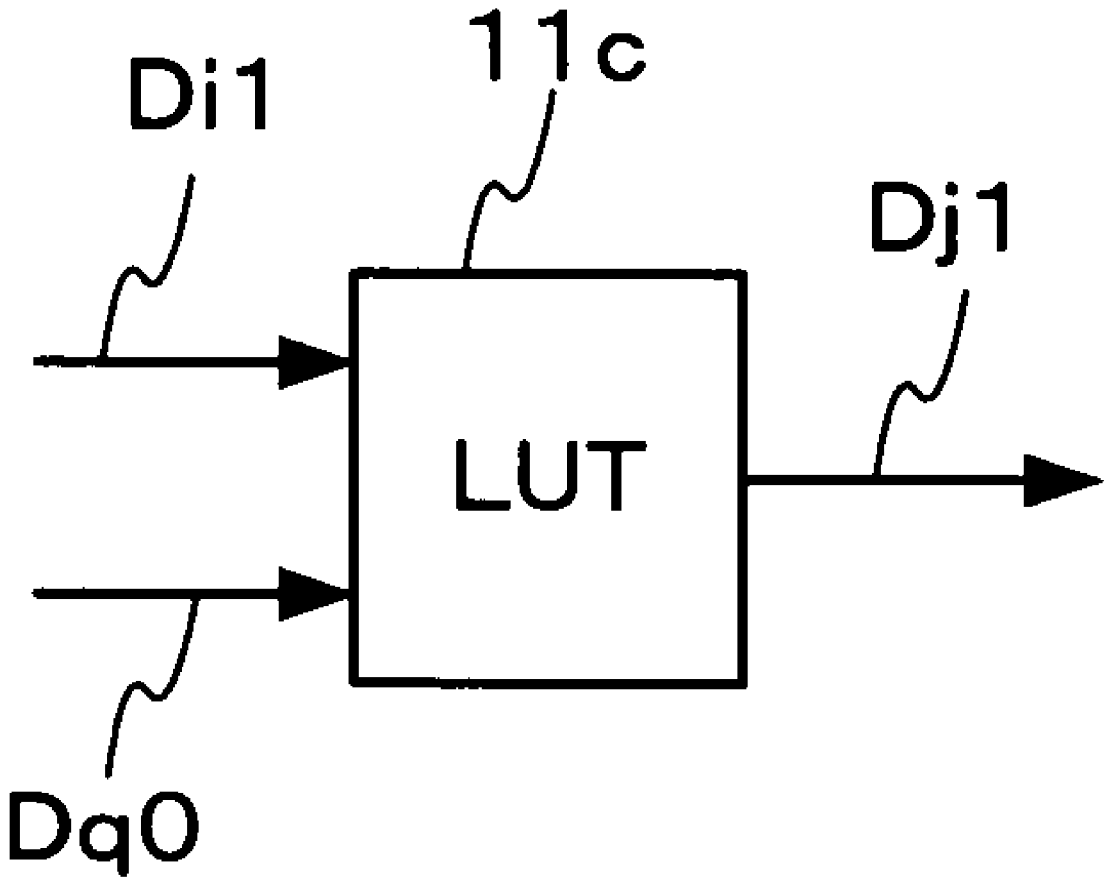
FIG. 13 is a block diagram illustrating an example of another internal configuration of the image data compensation unit.

FIG. 13 is a block diagram illustrating another internal configuration of the image data compensation unit 11 according to Embodiment 2. A look-up table 11*c* shown in FIG. 13 receives the one-frame-preceding image data $D_{q0}$ and the image data $D_{i1}$, and outputs the compensated image data $D_{j1}$ (=($D_{i1}$, $D_{q0}$)) based on values of both image data. The look-up table 11*c* stores the compensated image data $D_{j1}$ (=($D_{i1}$, $D_{q0}$)) obtained by adding to the image data $D_{i1}$ the compensation amounts $D_{c1}$ (=dt ($D_{i1}$, $D_{q0}$)) of 256×256 shown in FIG. 12. The compensated image data $D_{j1}$ is set not to exceed the gray-scale range in which the display unit 12 can display.

Figure 14:
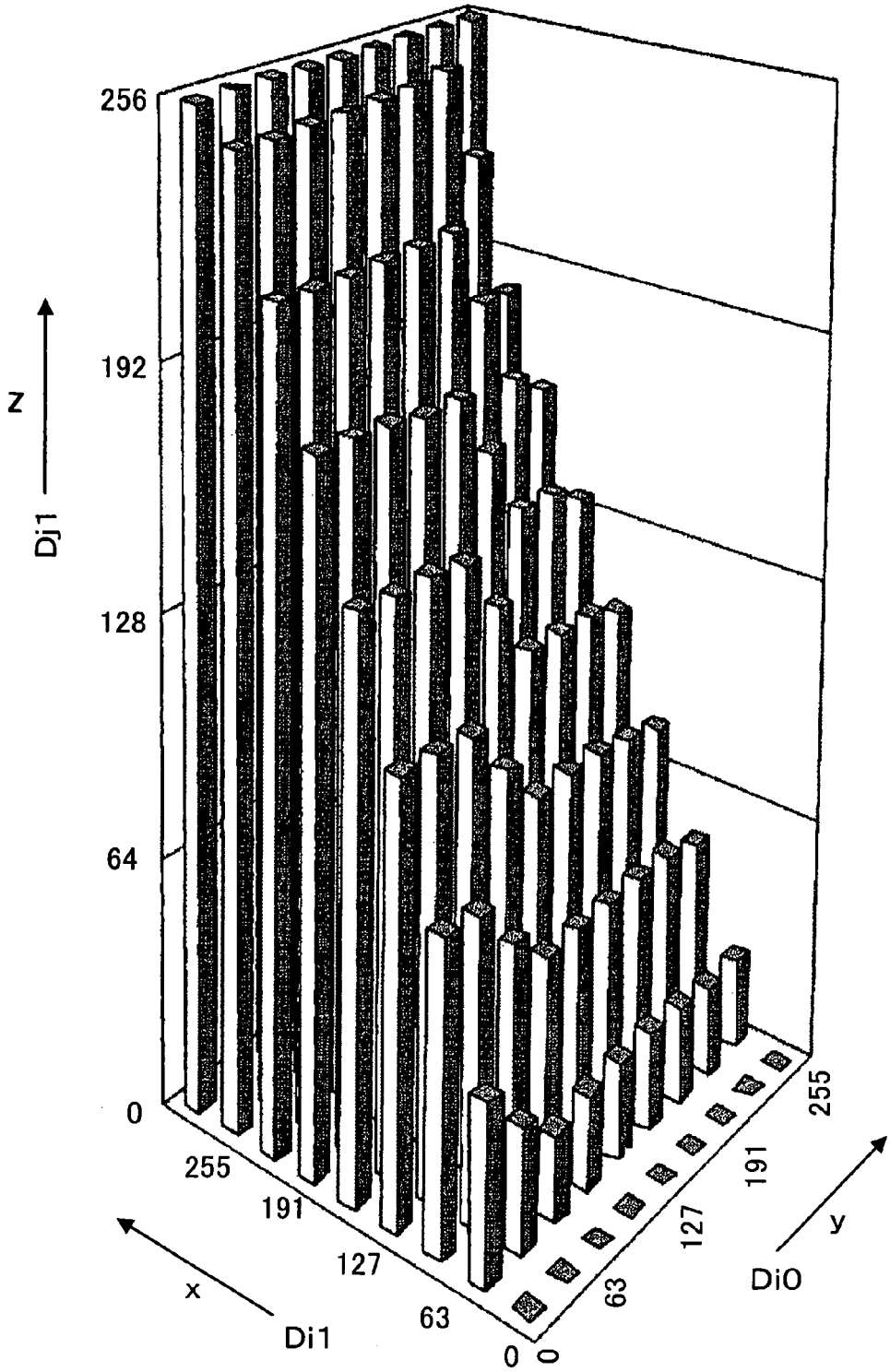
FIG. 14 is a histogram illustrating an example of compensated image data stored in the look-up table.

FIG. 14 is a diagram illustrating an example of the compensated image data $D_{j1}$ stored in the look-up table 11*c*. In case that gray-scale values of image data are represented by 8 bit data, there are 256×256 patterns of the compensation amount $D_{c1}$ in accordance with a gray-scale value combinations of image data $D_{i0}$ and $D_{i1}$. The compensation amounts corresponding to the gray-scale-value combination are indicated in FIG. 14, simplified into 8×8 patterns.

By storing the compensated image data $D_{j1}$ in the look-up table 11*c* and outputting the compensated image data $D_{j1}$ based on the image data $D_{q0}$ and $D_{i1}$, the calculation required to output the compensation amounts $D_{c1}$ can be further reduced.

Embodiment 3

Figure 15:
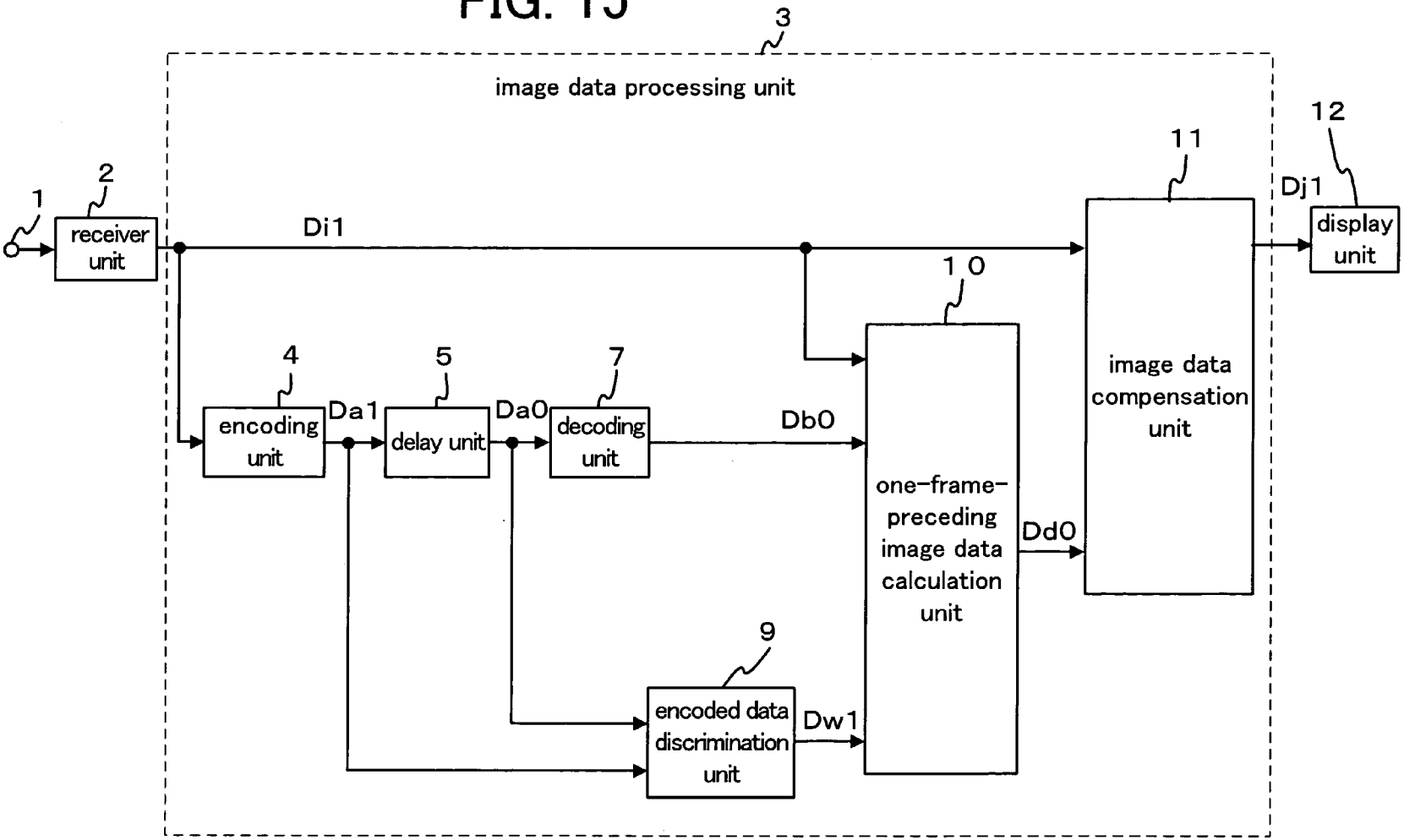
FIG. 15 is a block diagram illustrating another aspect of an image processing unit for driving a liquid crystal according to the invention.

FIG. 15 is a block diagram illustrating another configuration of the liquid crystal display device provided with the image processor according to the present invention. The image data processing unit 3 in the image processor according to Embodiment 3 is composed of the encoding unit 4, the delay unit 5, the decoding unit 7, the encoded data discrimination unit 9, the one-frame-preceding-image calculation unit 10, and the image data compensation unit 11. The same numeral references are assigned to components equivalent to those in the image data processing unit 3 shown in FIG. 1.

In the image data processing unit 3 according to Embodiment 3, the one-frame-preceding-image calculation unit 10 generates the one-frame-preceding image data $D_{q0}$ by selecting the image data $D_{i1}$ and the decoded image data $D_{b0}$ on a pixel to pixel basis based on only the control signal $D_{w1}$ outputted from the encoded data discrimination unit 9. If the control signal $D_{w1}=1$, the image data $D_{i0}$ is regarded as image data preceding by one frame and selected for an associated pixel. If the control signal $D_{w1}=0$, the image data $D_{i1}$ is regarded as image data preceding by one frame and selected for an associated pixel. A method of generating the control signal $D_{w1}$ is the same as that in Embodiment 1.

FIG. 16 through FIG. 18 are diagrams for explaining processes of generating the one-frame-preceding image data $D_{q0}$ in the image data processing unit 3 according to Embodiment 3.

The processes of generating the one-frame-preceding image data $D_{q0}$ will be explained in detail bellow with reference to FIG. 16 through FIG. 18. In the following explanations, $T_{ha}$, and $T_{hb}$ represents a threshold for respective variations $|L_{a1}-L_{a0}|$, $|L_{b1}-L_{b0}|$. These thresholds are $T_{ha}=10$ and $T_{hb}=20$, in the following explanation.

FIG. 16 are diagrams for explaining the processes of generating the one-frame-preceding image data $D_{q0}$ in case that a still image added with pseudo gray-scale signals by a dither processing is inputted.

FIGS. 16D and 16A indicate values of the image data $D_{i1}$ of a current frame and the image data $D_{i0}$ preceding by one frame, respectively. As shown in FIG. 16D, a pixel data (b, B) in the image data $D_{i1}$ of the current frame varies from 59 to 60 after being added with a pseudo gray-scale signal by the dither processing.

FIGS. 16B and 16E indicate the encoded data $D_{a0}$ and $D_{a1}$ corresponding to the image data $D_{i0}$ and $D_{i1}$ shown in FIGS. 16A and 16D, respectively. As shown in FIGS. 16B and 16E, the averaged values $L_{a0}$ and $L_{a1}$ and the dynamic ranges $L_{b0}$ and $L_{b1}$ of the image data $D_{i0}$ and $D_{i1}$ shown in FIGS. 16A and 16D are $L_{a0}=L_{a1}=60$ and $L_{b0}=L_{b1}=120$, respectively.

FIG. 16C indicates the decoded image data $D_{b0}$ obtained by decoding the encoded image data $D_{a0}$ shown in FIG. 16B.

FIG. 16F indicates a difference between the image data $D_{i0}$ and $D_{i1}$ shown in FIGS. 16A and 16D, an actual variation of the image.

FIG. 16G indicates the control signal $D_{w1}$ generated based on the encoded image data $D_{a0}$ and $D_{a1}$ shown in FIGS. 16B and 16E. As shown in FIGS. 16B and 16E, the averaged value variation between the current frame and the frame preceding by one frame $|L_{a1}-L_{a0}|=0$ and the dynamic range variation $|L_{b1}-L_{b0}|=0$, and both variations are smaller than the respective thresholds $T_{ha}=10$ and $T_{hb}=20$. The quantized value variation $|Q_1-Q_0|$ in the pixel (b, B) is 1 and $|Q_1-Q_0|$ in the other pixels are 0. Accordingly, the encoded data discrimination unit 9 outputs the control signal $D_{w1}=0$ for all pixels.

FIG. 16H indicates the one-frame-preceding image data $D_{q0}$ generated by selecting the decoded image data $D_{h0}$ shown in FIG. 16C or the image data $D_{i1}$ shown in FIG. 16D on a pixel to pixel basis, based on the control signal $D_{w1}$ shown in FIG. 16G. The control signal $D_{w1}=0$ for all pixels as shown in FIG. 16G. Accordingly, the one-frame-preceding-image calculation unit 10 generates the one-frame-preceding image data $D_{q0}$ by selecting the image data $D_{i1}$ of the current frame for all pixels.

FIG. 16I indicates an error between the image data $D_{i0}$ preceding by one frame shown in FIG. 16A and the one-frame-preceding image data $D_{q0}$ shown in FIG. 16H. As shown in FIG. 16I, the encoding and decoding error due to the pseudo gray-scale signals can be corrected, even in case of generating the one-frame-preceding image data $D_{q0}$ based on the control signal $D_{w1}$ only.

FIG. 17 are diagrams for explaining the operation of the image data processing unit 3 in a case of a motion image being inputted.

FIGS. 17A and 17D indicate values of the image data $D_{i1}$ of a current frame and the image data $D_{i0}$ preceding by one frame, respectively. Comparing the image data $D_{i0}$ with the image data $D_{i1}$ shown in FIGS. 17A and 17D, pixel data in the B, C and D column vary from 0 to 59, 59 to 60, and 60 to 0, respectively.

FIGS. 17B and 17E indicate the encoded image data $D_{a0}$, and $D_{a1}$ corresponding to the image data $D_{i0}$ and $D_{i1}$ shown in FIGS. 17A and 17D, respectively. As shown in FIGS. 17B and 17E, the averaged value and the dynamic range of the image data $D_{i0}$ and $D_{i1}$ shown in FIGS. 17A and 17D are $L_{a0}=30$, $L_{a1}=30$, $L_{b0}=60$ and $L_{b1}=60$, respectively.

FIG. 17C indicates the decoded image data $D_{b0}$ obtained by decoding the encoded image data $D_{a0}$ shown in FIG. 17B.

FIG. 17F indicates a difference between the image data $D_{i0}$ and $D_{i1}$ shown in FIGS. 17A and 17D, an actual variation of the image.

FIG. 17G indicates the control signal $D_{w1}$ that is outputted based on the encoded image data $D_{a0}$, and $D_{a1}$ shown in FIGS. 17B and 17E. As shown in FIGS. 17B and 17E, the averaged value variation between the current frame and the frame preceding by one frame $|L_{a1}-L_{a0}|=0$ and the dynamic range variation $|L_{b1}-L_{b0}|=0$, and both variations are smaller than the respective thresholds $T_{ha}=10$ and $T_{hb}=20$. A quantized value variation $|Q_1-Q_0|$ in pixels in the A and C columns is 0 and $|Q_1-Q_0|$ in pixels in the pixels in the B and D columns is 3. Accordingly, the encoded data discrimination unit 9 outputs the control signal $D_{w1}=0$ for the pixels in the A and C columns and the control signal $D_{w1}=1$ for the pixels in the B and C columns.

FIG. 17H indicates the one-frame-preceding image data $D_{q0}$ generated by selecting the decoded image data $D_{b0}$ shown in FIG. 17C or the image data $D_{i1}$ shown in FIG. 17D on a pixel to pixel basis either, based on the control signal $D_{w1}$ shown in FIG. 17G. As shown in FIG. 17G, the control signal $D_{w1}$ is 0 for pixels in the A and C columns and 1 for the pixels in the B and D columns. Accordingly, the one-frame-preceding-image calculation unit 10 generates the one-frame-preceding image data $D_{q0}$ by selecting the image data $D_{i1}$ of the current frame for the pixels in the A and C columns and selecting the decoded image data $D_{b0}$ for the pixels in the B and D columns.

FIG. 17I indicates an error between the image data $D_{i0}$ preceding by one frame shown in FIG. 17A and the one-frame-preceding image data $D_{q0}$ shown in FIG. 17H. As shown in FIG. 17I, by selecting the image data $D_{i1}$ of the current frame and the decoded image data $D_{b0}$, on a pixel to pixel basis, based on the control signal $D_{w1}$, the one-frame-preceding image data $D_{q0}$ can be correctly generated.

FIG. 18 are diagrams for explaining the operation of the image data processing unit 3 in case that another motion image being inputted.

FIGS. 18D and 18A indicate values of the image data D11 of a current frame and the image data $D_{i0}$ preceding by one frame, respectively. Comparing the image data $D_{i0}$ with the image data D11 shown in FIGS. 18A and 18D, pixel data in the B, C and D columns vary from 0 to 59, 59 to 60 and 60 to 120, respectively.

FIGS. 18B and 18E indicate the encoded image data $D_{a0}$, and $D_{a1}$ corresponding to the image data $D_{i0}$ and $D_{i1}$ shown in FIGS. 18A and 17D, respectively. As shown in. FIGS. 18B and 18E, the averaged values and dynamic ranges of the image data $D_{i0}$ and $D_{i1}$ shown in FIGS. 18A and 18D are $L_{a0}$=30, $L_{a1}$=60, $L_{b0}$=60 and $L_{b1}$=120, respectively.

FIG. 18C indicates the decoded image data $D_{b0}$ obtained by decoding the encoded image data $D_{a0}$ shown in FIG. 18B.

FIG. 18F indicates a differences between the image data $D_{i0}$ and $D_{i1}$ shown in FIGS. 18A and 18D, actual variations of the image.

FIG. 18G indicates the control signal $D_{w1}$ that is outputted based on the encoded image data $D_{a0}$ and $D_{a1}$ shown in FIGS. 18B and 18E. As shown in FIGS. 18B and 18E, the averaged value variation between the current frame and the frame preceding by one frame $|L_{a1}-L_{a0}|$=30 and the dynamic range variation $|L_{b1}-L_{b0}|$=60, respectively, both exceeding the respective threshold $T_{ha}$=10 and $T_{hb}$=20. Accordingly, the control signal $D_{w1}$=1 is outputted for all pixels in the block.

FIG. 18H indicates the one-frame-preceding image data $D_{q0}$ generated by selecting the decoded image data $D_{b0}$ shown in FIG. 18C or the image data D11 shown in FIG. 18D on a pixel to pixel basis, based on the control signal $D_{w1}$ shown in FIG. 18G. Since the control signal $D_{w1}$=1 for all pixels as shown in FIG. 18G, the one-frame-preceding-image calculation unit 10 generates the one-frame-preceding image data $D_{q0}$ by selecting the decoded image data $D_{b0}$ for all pixels.

FIG. 18I indicates an error between the image data $D_{i0}$ preceding by one frame shown in FIG. 18A and the one-frame-preceding image data $D_{q0}$ shown in FIG. 18H. As shown in FIG. 18I, by selecting the decoded image data $D_{b0}$ as image data preceding by one frame, when the averaged value variation $|L_{a1}-L_{a0}|$ and the dynamic range variation $|L_{b1}-L_{b0}|$ of the block both exceed the respective predetermined thresholds ($T_{ha}$, $T_{hb}$), the one-frame-preceding image data $D_{q0}$ can be correctly generated with a small error.

As explained above with reference to FIG. 16 through FIG. 18, by selecting the one-frame-preceding image data $D_{b0}$ or the image data D11 on a pixel to pixel basis, base on only the control signal $D_{w1}$, the one-frame-preceding image data $D_{q0}$ can also be correctly generated without an influence of the encoding and decoding error.

Figure 19:
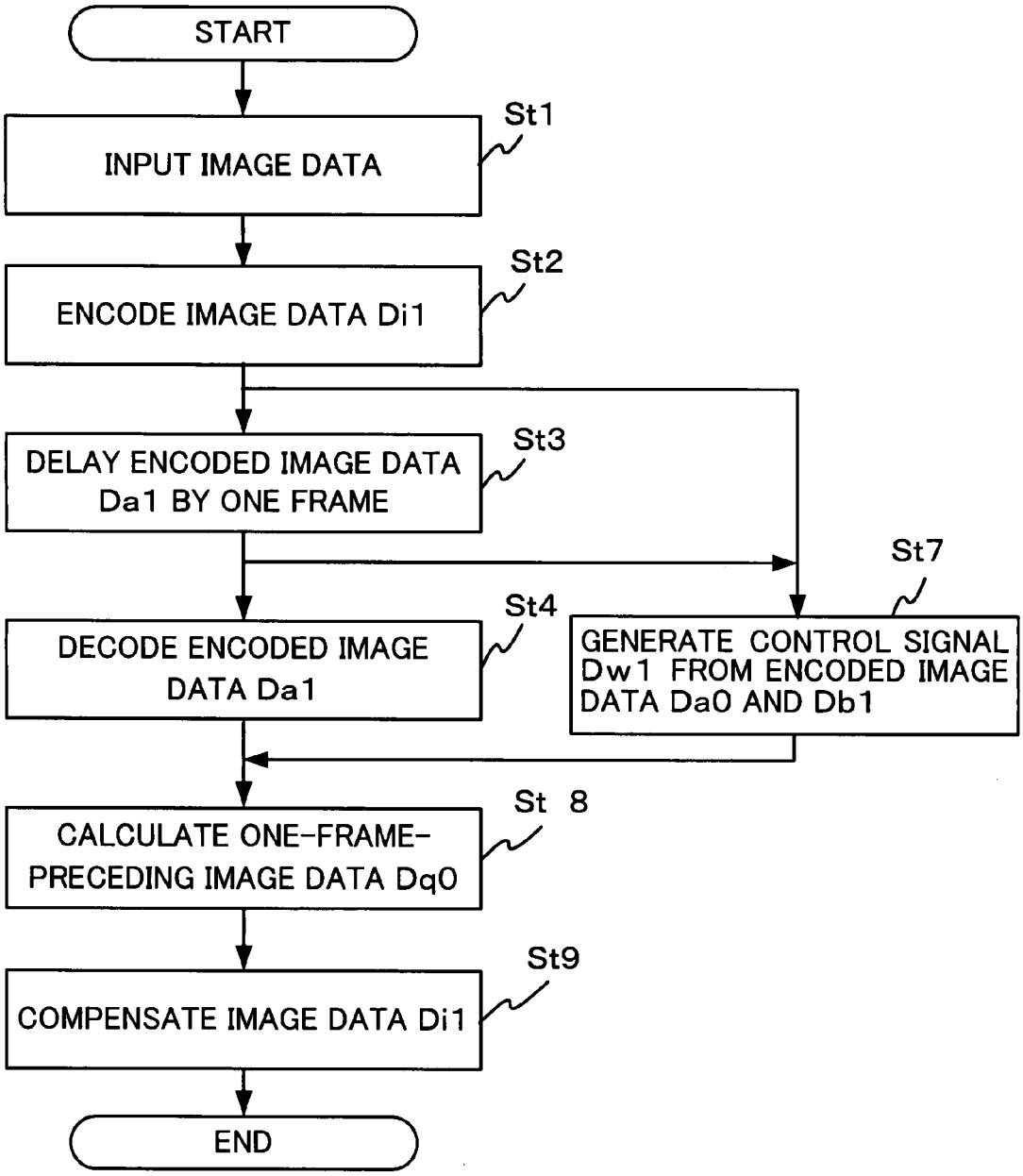
FIG. 19 is a flow chart illustrating another operation of the image processor for driving the liquid crystal according to the invention.

FIG. 19 is a flow chart illustrating the above-explained processing steps executed by the image processing unit for driving the liquid crystal according to Embodiment 3.

First, the image data $D_{i1}$ is inputted into the image data processing unit 3 (St1). The encoding unit 4 encodes the image data $D_{i1}$ inputted thereto, and outputs the encoded image data $D_{a1}$ (St2). The delay unit 5 delays the encoded image data $D_{a1}$ for one frame period, and output the encoded image data $D_{a0}$ preceding by one frame (St3). The decoding unit 7 decodes the encoded image data $D_{a0}$ and outputs the decoded image data $D_{b0}$ corresponding to the image data $D_{i0}$ preceding by one frame (St4). In parallel with this process, the encoded data discrimination unit 9 compares the encoded image data $D_{a0}$ preceding by one frame with the image data $D_{i1}$ of the current frame, and in case that the variation $|L_{a1}-L_{a0}|$ and $|L_{b1}-L_{b0}|$ of the block both exceed the respective predetermined thresholds ($T_{ha}$, $T_{hb}$), the control signal $D_{w1}$=1 is outputted for all pixels in the block. On the other hand, in case that the variations $|L_{a1}-L_{a0}|$ and $|L_{b1}-L_{b0}|$ are equal to or smaller than the respective thresholds, the control signal $D_{w1}$=0 is outputted for pixel of which quantized value variation $|Q_1-Q_0|$ is 0 or 1, and the control signal $D_{w1}$=1 is outputted for a pixel of which variation $|Q_1-Q_0|$ is larger than 1 (St7).

The one-frame-preceding-image calculation unit 10 selects the decoded image data $D_{b0}$ as image data preceding by one frame for a pixel of which control signal $D_{w1}$=1 and selects the image data $D_{i1}$ as image data preceding by one frame for a pixel of which control signal $D_{w1}$=0, and outputs the one-frame-preceding image data $D_{q0}$ (St18).

The image data compensation unit 11 calculates compensation amounts necessary for driving the liquid crystal to reach predetermined transmittances designated by the image data $D_{i1}$ within one frame period based on changes in the gray-scale values obtained by comparing the one-frame-preceding image data $D_{q0}$ with the image data $D_{i1}$, and compensates the image data $D_{i1}$ using the compensation amounts, and output the compensated image data $D_{j1}$ (St9).

The processing steps St1 through St9 are executed for each pixel of the image data D11.

Embodiment 4

Figure 20:
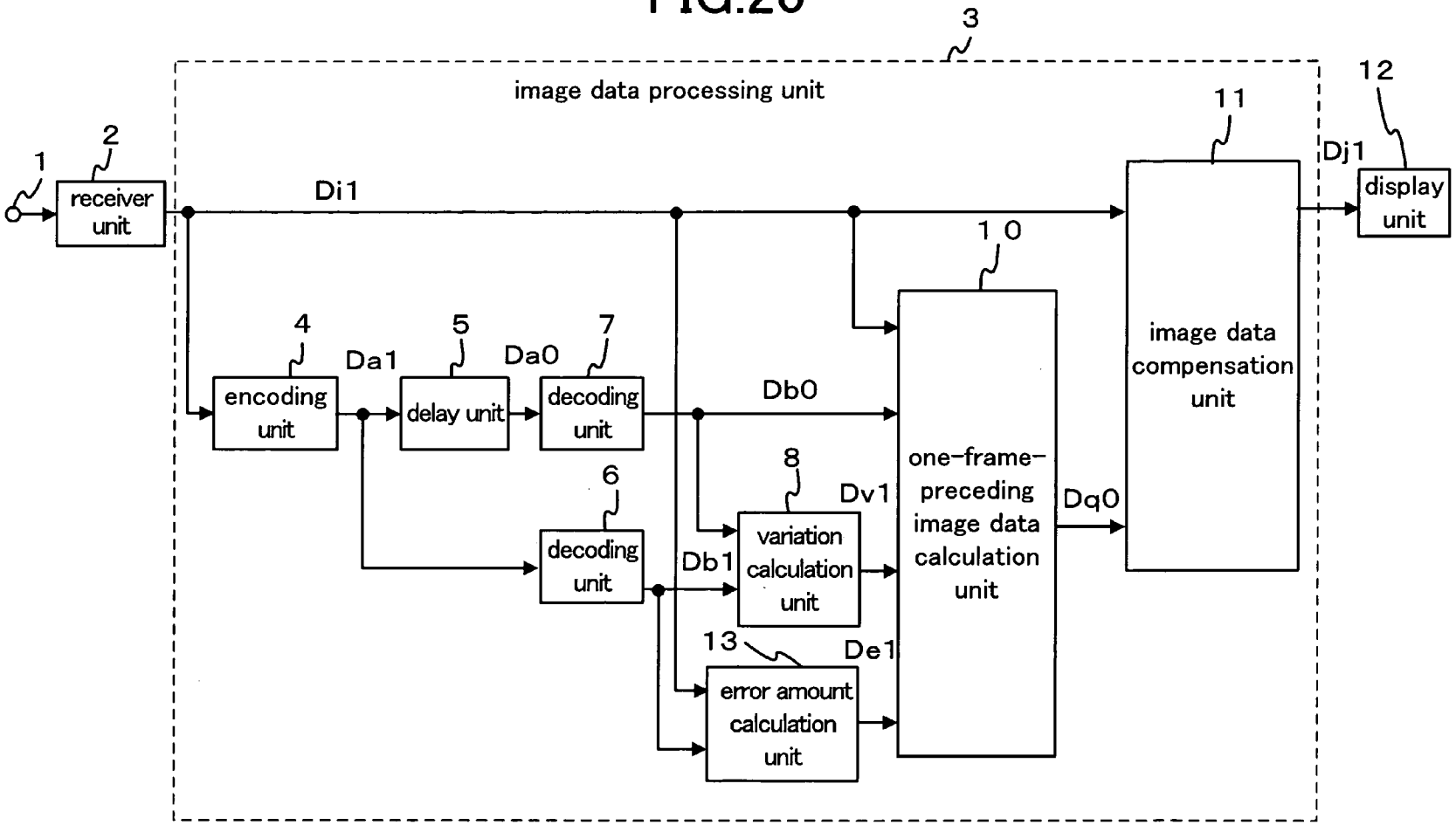
FIG. 20 is a block diagram illustrating still another aspect of an image processing unit for driving a liquid crystal according to the invention.

FIG. 20 is a block diagram illustrating another configuration of a liquid crystal display device provided with an image processor according to the present invention. The image data processing unit 3 according to Embodiment 4 is composed of the encoding unit 4, the delay unit 5, the decoding units 6 and 7, the variation calculation unit 8, an error amount calculation unit 13, the one-frame-preceding-image calculation unit 10, and the image data compensation unit 11. The same numeral references are assigned to components equivalent to those in the image data processing unit 3 shown in FIG. 1. Operation of each unit other than the error amount calculation unit 13 is same as that described in Embodiment 1.

The error amount calculation unit 13 calculates differences between the decoded image data $D_{b1}$ corresponding to current-frame image data and the image data $D_{i1}$ on a pixel to pixel basis, and output absolute values of the differences as error amounts $D_{e1}$. The error amounts $D_{e1}$ are inputted into the one-frame-preceding-image calculation unit 10.

The one-frame-preceding-image calculation unit 10 generates the one-frame-preceding image data $D_{q0}$ by selecting the image data $D_{i1}$ as image data preceding by one frame for a pixel of which variation $D_{v1}$ is smaller than the predetermined threshold $SH_0$ and for a pixel of which variation $D_{v1}$ is larger than the threshold $SH_0$ and equal to two times of the error amounts $D_{e1}$, and selecting the decoded image data $D_{b0}$ as image data preceding by one frame for a pixel of which variation $D_{v1}$ is larger than the threshold value $SH_0$ and of which variation $D_{v1}$ is not equal to two times of the error amounts $D_{e1}$. The one-frame-preceding image data $D_{q0}$ is inputted into the image data compensation unit 11.

The image data compensation unit 11 compensates the image data $D_{i1}$ so that the liquid crystals reach predetermined transmittances designated by the image data $D_{i1}$ within one frame period, based on changes in the gray-scale values obtained by comparing the image data $D_{i1}$ with the one-frame-preceding image data $D_q$, and outputs the compensated image data $D_{j1}$.

FIG. 21 are diagrams for explaining processes of generating the one-frame-preceding image data $D_{q0}$ when a still image with pseudo gray-scale signals added by a dither processing is inputted. In the following explanations, the predetermined threshold $SH_0$ used in generating the one-frame-preceding image data $D_{q0}$ is $SH_0$=8.

FIGS. 21D and 21A indicate values of the image data $D_{i1}$ of a current frame and the image data $D_{i0}$ preceding by one frame, respectively. As shown in FIG. 21D, a pixel data (b, B) in the image data $D_{i1}$ of the current frame varies 59 to 60 after being added with a pseudo gray-scale signal by the dither processing.

FIGS. 21E and 21B indicate encoded data encoded by FBTC from the image data $D_{i1}$ of the current frame and the image data $D_{i0}$ preceding by one frame. Here, the averaged value $L_a$ and the dynamic range $L_b$ of each of the blocks are represented by 8 bit data, and quantization is performed by assigning 2 bits to each pixel.

FIGS. 21F and 21C indicate the decoded image data $D_{b1}$ of the current frame and the decoded image data $D_{b0}$ preceding by one frame, both obtained by decoding the encoded data shown in FIGS. 21E and 21B, respectively. While the image data $D_{i1}$ and corresponding decoded image data $D_{b1}$ are 59 and 40, respectively, the image data $D_{i1}$ and corresponding decoded image data $D_{b1}$ in the pixel (b, B), where a pseudo gray-scale signal is added, are 60 and 80, respectively, as shown in FIGS. 21D and 21F.

FIG. 21G indicates a difference between the image data $D_{i0}$ and $D_{i1}$ shown in FIGS. 21A and 21D, actual variations of the image. FIG. 21H indicates the variation $D_{v1}$ that represents absolute values of the differences between the decoded image data $D_{b0}$ and $D_{b1}$ shown in FIGS. 21C and 21F. As shown in FIG. 21G, while a difference between the image data $D_{i0}$ and $D_{i1}$ in the pixel data (b, B) is 1, the variation $D_{v1}$, a difference between the decoded image data $D_{b0}$ and $D_{b1}$, in the same pixel is 40 due to the encoding and decoding error.

FIG. 21I indicates the error amount $D_{e1}$ that represents absolute value of difference between the image data $D_{i1}$ of the current frame shown in FIG. 21D and the decoded image data $D_{b1}$ of the current frame shown in FIG. 21F.

FIG. 21J indicates the one-frame-preceding image data $D_{q0}$ generated by selecting the image data $D_{i1}$ or the decoded image data $D_{b0}$ shown in FIGS. 21D and 21C, respectively, on a pixel to pixel basis based on the variation $D_{v1}$ shown in FIG. 21H and the error amounts $D_{e1}$ shown in FIG. 21I. Since the variation $D_{v1}$ are all 0 in pixels except for the pixel (b, B) as shown in FIG. 21H, the one-frame-preceding-image calculation unit 10 selects the image data $D_{i1}$ as one-frame-preceding image data for the pixels except for the pixel (b, B). On the other hand, since a value of the variation $D_{v1}$ of the pixel (b, B) is larger than the threshold $SH_0$, and the value of the variation $D_{v1}$ (=40) is equal to two times of the corresponding value of the error amounts $D_{e1}$ (=20), the one-frame-preceding-image calculation unit 10 selects the image data $D_{i1}$ as a one-frame-preceding data for the pixel (b, B).

FIG. 21K indicates an error between the one-frame-preceding image data $D_{q0}$ and the image data $D_{i0}$ preceding by one frame. As shown in FIG. 21K, an error in the pixel (b, B) added with a pseudo gray-scale signal by the dither processing is 1. This means the influence of the encoding and decoding error is prevented.

FIG. 22 are diagrams for explaining the encoding and decoding error shown in FIG. 21.

Figures 22A, 22B, 22C, 22D:
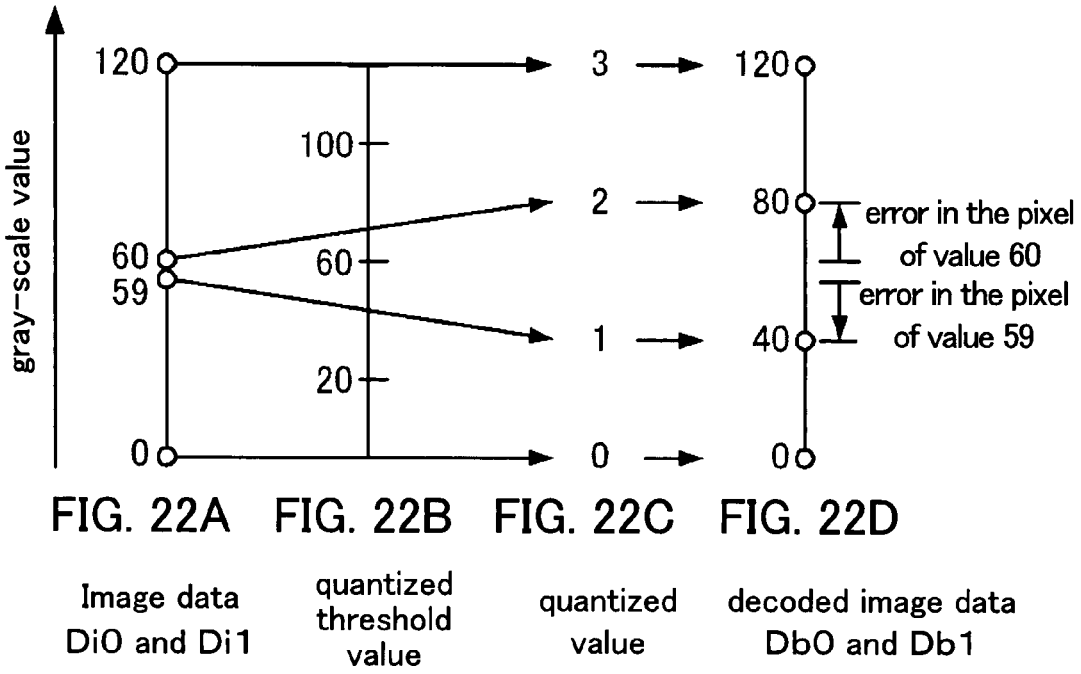
FIG. 22 is diagrams for explaining an encoding/decoding error.

FIG. 22A indicates gray-scale values of the image data $D_{i0}$ and $D_{i1}$ represented by 8 bit data. FIG. 22B indicates quantizing thresholds for the image data $D_{i0}$ and $D_{i1}$. FIG. 22C indicates quantized values of the image data $D_{i0}$ and $D_{i1}$ shown in FIG. 22A obtained by quantizing these data into 2 bit data using the quantizing thresholds shown in FIG. 22B. FIG. 22D indicates gray-scale values of the decoded image data $D_{b0}$ and $D_{b1}$ obtained by decoding these data into 8 bit data using the quantized values shown in FIG. 22C.

Since the image data $D_{i0}$ and $D_{i1}$ are quantized using the thresholds of 20, 60, and 100 as shown in FIG. 22B, quantized values corresponding to gray-scale values of 0, 59, 60, and 120 are 0, 1, 2, and 3, respectively, as shown in FIG. 22C. When the quantized values shown in FIG. 22C are decoded, the gray-scale values of 0, 59, 60, and 120 in the image data $D_{i0}$ and $D_{i1}$ are converted into 0, 40, 80, and 120, respectively, as shown in FIG. 22D. As indicated by this example, when such two gray-scale values as 59 and 60 in the image data $D_{i0}$ and $D_{i1}$, one of which is equal to or larger than the quantizing threshold and the other one is smaller than the quantizing threshold, are decoded, these values are converted into 40 and 80, respectively, while an actual variation is 1. As a result, corresponding value of the variation $D_{v1}$ obtained from the decoded image data $D_{b0}$ and $D_{b1}$ becomes 40, producing large error.

As previously explained, the one-frame-preceding-image calculation unit 10 generates the one-frame-preceding image data $D_{q0}$ by selecting the image data $D_{i1}$ as image data preceding by one frame for pixels of which variations $D_{v1}$ are larger than the predetermined threshold $SH_0$ and equal to two times of the error amounts $D_{e1}$, and selecting the decoded image data $D_{b0}$ as image data preceding by one frame for pixels of which variations $D_{v1}$ are larger than the threshold $SH_0$ and not equal to two times of the error amounts $D_{e1}$. Accordingly, since the pixel (b, B) in the image data $D_{i1}$ shown in FIG. 21D is regarded as representing a still image, the image data $D_{i1}$ is selected as image data preceding by one frame. Therefore, the one-frame-preceding image data $D_{i0}$ can be correctly generated without affected by the error in the variation $D_{v1}$ caused by the encoding and decoding error. This means, even in case that image data $D_{i1}$ added with pseudo gray-scale signals are inputted, the one-frame-preceding image data $D_{q1}$ can be generated without affected by the encoding and decoding error.

FIG. 23 are diagrams for explaining processes of generating the one-frame-preceding image data $D_{q0}$ when a motion image is inputted. In the following explanations, the predetermined threshold $SH_0$ used in generating the one-frame-preceding image data $D_{q0}$ is $SH_0$=8.

FIGS. 23D and 23A indicate values of the image data $D_{i1}$ of a current frame and the image data $D_{i0}$ preceding by one frame, respectively. Comparing the image data $D_{i0}$ with $D_{i1}$ shown in FIGS. 23A and 23D, pixel data in the B, C and D columns vary from 0 to 59, 59 to 60 and 60 to 0.

FIGS. 23B and 23E indicate encoded data obtained by encoding the image data $D_{i0}$ preceding by one frame and the image data $D_{i1}$ of the current frame using FBTC.

FIGS. 23C and 23F indicate the decoded image data $D_{b0}$ preceding by one frame and the image data $D_{b1}$ of the current frame obtained by decoding the encoded data shown in FIGS. 23B and 23E.

FIG. 23G indicates a difference between the image data $D_{i0}$ and $D_{i1}$ shown in FIGS. 23A and 23D, actual variations of the image. FIG. 23H indicates the variation $D_{v1}$ representing absolute values of a difference between the decoded image data $D_{b0}$ and $D_{b1}$ shown in FIGS. 23C and 23F.

FIG. 23I indicates error amounts $D_{e1}$ that are absolute values of differences between the image data $D_{i1}$ of the current frame shown in FIG. 23D and the decoded image data $D_{b1}$ of the current frame shown in FIG. 23F.

FIG. 23J indicates the one-frame-preceding image data $D_{q0}$ generated by selecting the image data $D_{i1}$ or the decoded image data $D_{b0}$ shown in FIGS. 23D and 23C on a pixel to pixel basis, based on the variation $D_{v1}$ shown in FIG. 23H and the error amounts $D_{e1}$ shown in FIG. 23I. The variation $D_{v1}$ in the B and D columns is 60, exceeding the threshold ($SH_0$=8), and not equal to two times of the error amounts $D_{e1}$. The variation $D_{v1}$ in A and C columns is 0, equal to or smaller than the threshold. Accordingly, the one-frame-preceding-image calculation unit 10 generates the one-frame-preceding image data $D_{q0}$ by selecting the image data $D_{i1}$ of the current frame for pixels in the A and C columns and selecting the decoded image data $D_{b0}$ for pixels in the B and D columns.

FIG. 23K indicates an error between the one-frame-preceding image data $D_{q0}$ and the image data $D_{i0}$ preceding by one frame.

FIG. 24 are diagrams for explaining the encoding and decoding error shown in FIG. 23.

FIG. 24A indicates gray-scale values of the image data $D_{i0}$ and $D_{i1}$ represented by 8 bit data. FIG. 24B indicates quantizing thresholds used for quantizing the image data $D_{i0}$ and $D_{i1}$. FIG. 24C indicates quantized values of the image data $D_{i0}$ and $D_{i1}$ shown in FIG. 24A obtained by quantizing these data into 2 bit data using the quantizing thresholds shown in FIG. 24B. FIG. 24D indicates gray-scale values of the decoded image data $D_{b0}$ and $D_{b1}$ obtained by decoding these data into 8 bit data using the quantized values shown in FIG. 24C.

Since the image data $D_{i0}$ and $D_{i1}$ are quantized using the thresholds of 10, 30, and 50 as shown in FIG. 24B, quantized values corresponding to gray-scale values of 0, 59, and 60 are 0, 60, and 60, respectively, as shown in FIG. 24C. When the quantized values shown in FIG. 24C are decoded, the gray-scale values of 0, 59, and 60 in the image data $D_{i0}$ and $D_{i1}$ are converted into 0, 60, and 60, respectively, as shown in FIG. 24D. As a result, when the gray-scale values of 59 and 60 in the image data $D_{i0}$ and $D_{i1}$ are decoded, both of these data are converted into 60, producing an error equivalent to one level in gray-scale.

As previously explained, the one-frame-preceding-image calculation unit 10 generates the one-frame-preceding image data $D_{q0}$ by selecting the image data $D_{i1}$ as image data preceding by one frame for pixels of which variation $D_{v1}$ is smaller than the predetermined threshold $SH_0$, and selecting the decoded image data $D_{b0}$ as image data preceding by one frame for a pixel of which variation $D_{v1}$ is larger than the threshold $SH_0$ and not equal to two times of the error amounts $D_{e1}$. Therefore, even in case that a motion image is inputted, the one-frame-preceding image data $D_{i0}$ can be correctly generated without affected by the encoding and decoding error.

Figure 25:
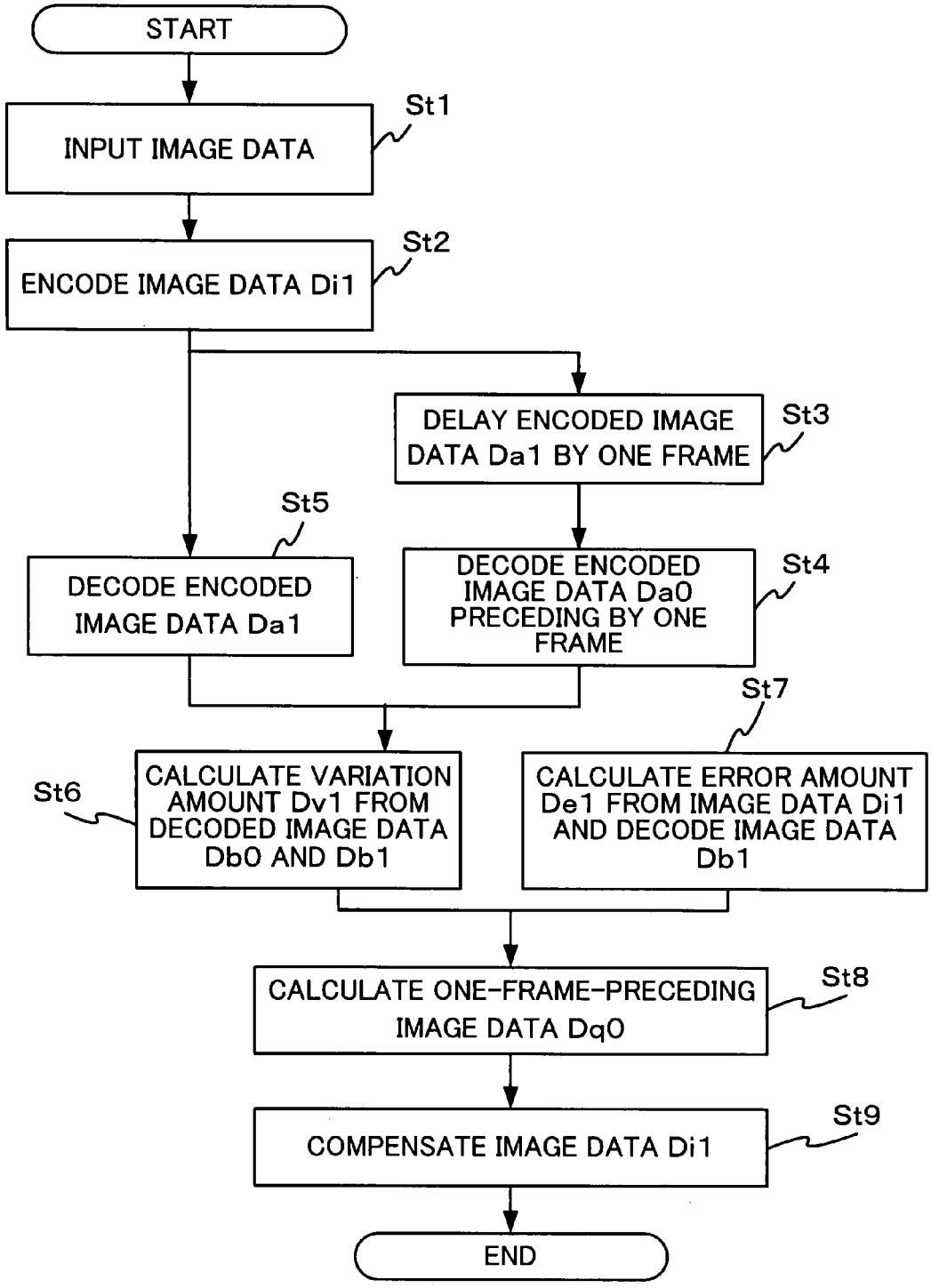
FIG. 25 is a flow chart illustrating another operation of the image processor.

FIG. 25 is a block diagram illustrating the above-explained processing steps executed by the image data processing unit 3 in the image processor according to this invention.

First, the image data $D_{i1}$ is inputted into the image data processing unit 3 (St1). The encoding unit 4 encodes the image data $D_{i1}$ inputted thereto and outputs the encoded image data $D_{a1}$ (St2). The delay unit 5 delays the encoded image data $D_{a1}$ for one frame period, and output the encoded image data $D_{a0}$ preceding by one frame (St3). The decoding unit 7 decodes the encoded image data $D_{a0}$ and outputs the decoded image data $D_{b0}$ corresponding to the image data $D_{i0}$ preceding by one frame (St4). In parallel with these processing, the decoding unit 6 decodes the encoded image data $D_{a1}$, and output the decoded image data $D_{b1}$ corresponding to the image data $D_{i1}$ of a current frame (St5).

The variation calculation unit 8 calculates differences between the decoded image data $D_{b1}$ of the current frame and the image data $D_{b0}$ preceding by one frame on a pixel to pixel basis, and output the differences as the variation $D_{v1}$. (St6). In parallel with this process, the error amount calculation unit 13 calculates differences between the decoded image data $D_{b1}$ of the current frame and the image data $D_{i1}$ of the current frame, and output a difference as the error amount $D_{e1}$ (St7).

The one-frame-preceding-image calculation unit 10 generates the one-frame-preceding image data $D_{q0}$ by selecting the image data $D_{i1}$ of the current frame as image data preceding by one frame for a pixel of which variation $D_{v1}$ is smaller than the predetermined threshold $SH_0$ and for a pixel of which variation $D_{v1}$ is larger than the predetermined threshold $SH_0$ and equal to two times of the error amounts $D_{e1}$, and selecting the decoded image data $D_{b0}$ preceding by one frame as image data preceding by one frame for a pixel of which absolute values of the variation $D_{v1}$ is larger than the predetermined threshold $SH_0$ and not equal to two times of the error amounts $D_{e1}$, (St8).

The image data compensation unit 11 compares the one-frame-preceding image data $D_{q0}$ with the image data $D_{i0}$ and calculates compensation amounts necessary for driving the liquid crystal to reach predetermined transmittances designated by the image data $D_{i1}$ within one frame period based on changes in the gray-scale values. Then, the image data compensation unit 11 compensates the image data $D_{i1}$ using the compensation amounts and output the compensated image data $D_{j1}$ (St9).

The processing steps St1 through St9 are executed for each pixel of the image data $D_{i1}$.

As explained above, an image processor according to the present invention selects the image data $D_{i1}$ as image data preceding by one frame for a pixel of which variation $D_{v1}$ of the decoded image data $D_{b0}$ and $D_{b1}$ is smaller than the predetermined threshold $SH_0$, regarding this pixel as a still image. As for a pixel of which variation $D_{v1}$ is larger than the threshold $SH_0$, the image data D11 is selected when the variation $D_{v1}$ is equal to two times of the error amount $D_{e1}$, regarding this pixel as a motion image, and the encoded image data $D_{b0}$ is selected when the variation $D_{v1}$ is not equal to two times of the error amounts $D_{e1}$, regarding this pixel as a motion the image. As shown in FIG. 21, even when the image data $D_{i1}$ and $D_{i0}$ that include gray-scale values one of which is equal to or larger than a quantizing threshold and the other one is smaller than the this quantizing threshold are inputted, the one-frame-preceding image data $D_{q0}$. can be generated without affected by the encoding and decoding error. Therefore, even in cases that image data added with pseudo gray-scale signals are inputted, the appropriate compensation voltages can be applied to the liquid crystal.

The one-frame-preceding image data $D_{q0}$ may be calculated by the following Formula (3):

$$D_{q0}=k_1\times k_2\times D_{b0}+(1-k_1\times k_2)\times D_{i1} \quad (3).$$

In Formula (3) above, $k_1$ is a coefficient that varies depending on the variation $D_{v1}$, and $k_2$ is a coefficient that varies depending on the variation $D_{v1}$ and the control signal $D_{w1}$.

Figure 26A:
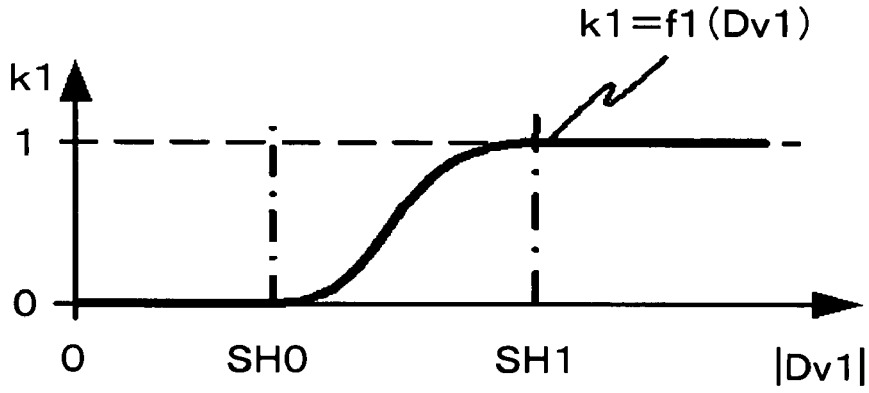
FIG. 26 is graphs illustrating characteristics of variables $k_1$ and $k_2$.
Figure 26B:
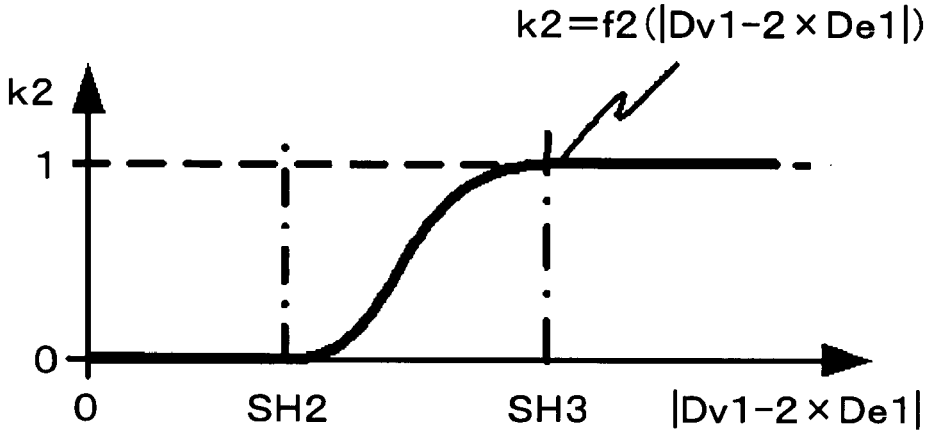

FIG. 26A is a graph illustrating a relationship between the coefficient $k_1$ and the variation $D_{v1}$. FIG. 26B is a graph illustrating a relationship between the coefficient $k_2$, and the variation $D_{v1}$ and the error amounts $D_{e1}$. As shown in FIG. 26A, the two thresholds $SH_0$ and $SH_1$ ($SH_0<SH_1$) are set for the absolute values of the variation $D_{v1}$; $k_1=0$ when $|D_{v1}|<SH_0$; $k_1$, $0<k_1<1$ when $SH_0\leqq|D_{v1}|\leqq SH_1$, and $k_1=1$ when $SH_1<|D_{v1}$. As shown in FIG. 26B, the two thresholds $SH_2$ and $SH_3$ ($SH_2<SH_3$) are also set for a differences between the variation $D_{v1}$ and two times of the error amounts $D_{e1}$ ($|D_{v1}-2\times D_{e1}|$); $k_2=0$ when $|D_{v1}-2\times D_{e1}|<SH_2$, $0<k_2<1$ when $SH_2\leqq|D_{v1}-2\times D_{e1}|\leqq SH_3$, and $k_2=1$ when $SH_3<|D_{v1}-2\times D_{e1}|$.

As shown in Formula (3), when either $k_1$ or $k_2$ is 0, the image data $D_{i1}$ is selected as the one-frame-preceding image data $D_q$, and when both $k_1$ and $k_2$ are 1, the decoded image data $D_{b0}$ is outputted as the one-frame-preceding image data $D_{q0}$. In case other than above, weighted averages of the image data $D_{i1}$ and the decoded image data $D_{b0}$ are calculated as the one-frame-preceding image data $D_q$, based on the product of $k_1$ and $k_2$.

By using Formula (3), the one-frame-preceding image data $D_{q1}$ varies continuously between the image data $D_{i1}$ and the decoded image data $D_{b0}$ depending on the variation $D_{v1}$, thereby preventing a motion image region from changing abruptly.

The invention claimed is:

1. An image processor that corrects image data representing a gray-scale value of each of pixels of an image, based on a change in the gray-scale value of each pixel, the image processor comprising:

an encoding unit that divides a current-frame image into a plurality of blocks and outputting first encoded image data, corresponding to the current-frame image, the first encoded image data including a representative value denoting a magnitude of pixel data of each of the blocks and a quantized value of pixel data in each of the blocks, the quantized value being obtained by quantizing the pixel data in each blocks based on the representative value;

a decoding unit that decodes the first encoded image data thereby outputting first decoded image data corresponding to the current-frame image;

a delay unit that delays the first encoded image data for a period equivalent to one frame, thereby outputting second encoded image data corresponding to the image preceding the current frame by one frame;

a decoding unit that decodes the second encoded image data, thereby outputting second decoded image data corresponding to the image preceding the current frame by one frame;

an encoded data discrimination unit that calculates variations of the representative value and the quantized value between the current-frame image and the image preceding by one frame by referring to the first and the second encoded image data, the encoded data discrimination unit determining whether each pixel of the current frame represents a still picture or a motion picture based on the variations of the representative values and the quantized value, and generating a control signal which has a first value for a pixel which determined to represent the still picture and has a second value for a pixel which determined to represent the motion picture;

a one-frame-preceding-image calculation unit that generates one-frame-preceding image data by selecting the current-frame image data or the second decoded image data on a pixel to pixel basis, based on the control signal; and an image data compensation unit that compensates a gray-scale value of the current-frame image, based on the current-frame image data and the one-frame-preceding image data.

2. The image processor as recited in claim 1, wherein:

said encoding unit uses an averaged value of pixel data and a dynamic range in each of the blocks as the representative values; and said discrimination unit calculates the variations of the averaged value and the dynamic range as the variations of the representative values.

3. The image processor as recited in claim 1, wherein:

said encoded data discrimination unit outputs a first control signal defining a pixel as a still image for a pixel of which variation of the quantized value is 0 or one and a second control signal defining a pixel as a motion image for a pixel of which variation of the quantized value exceeds 1, in a block where the variation of the representative value is smaller than a predetermined threshold; and said one-frame-preceding-image calculation unit generates the one-frame-preceding image data by selecting the current-frame image data for a pixel where the first control signal is outputted and selecting the second decoded image data for a pixel where the second control signal is outputted for.

4. The image processor as recited in claim 3, wherein said encoded data discrimination unit outputs the second control signal defining a pixel as a motion image, for all pixels in a block of which variation of the representative value is larger than the predetermined threshold.

5. The image processor as recited in claim 1, further comprising a variation calculation unit that calculates a variation between the first and the second decoded image data on a pixel to pixel basis, wherein:

said encoded data discrimination unit outputs a first control signal defining a pixel as a still image for a pixel of which variation of the quantized value is 0 or 1 and a second control signal defining a pixel as a motion image for a pixel of which variation of the quantized value exceeds one, in a block where the variation of the representative value is smaller than a predetermined threshold; and said one-frame-preceding-image calculation unit generates the one-frame-preceding image data by selecting the current-frame image data for a pixel, the variation of which is smaller than a predetermined threshold, and for a pixel where the first control signal is outputted, and selecting the second decoded image data for a pixel, the variation of which exceeds the predetermined threshold, where the second control signal is outputted.

6. The image processor as recited in claim 5, wherein the encoded data discrimination unit outputs the second control signal defining a pixel as a motion image, for all pixels in a block where the variation of the representative value is larger than a predetermined threshold.

7. The image processor as recited in claim 1, further comprising a variation calculation unit that calculates a variation between the first and the second decoded image data on a pixel to pixel basis, wherein:

the encoded data discrimination unit outputs a first control signal defining a pixel as a still image for a pixel of which variation of the quantized value is 0 or 1 and a second control signal defining a pixel as a motion image for a pixel of which variation of the quantized value exceeds 1, in a block where the variation of the representative value is smaller than a predetermined threshold; and the one-frame-preceding image calculation unit generates the one-frame-preceding image data by selecting the current-frame image data for a pixel, the variation of which is smaller than a first threshold, and for a pixel where the first control signal is outputted, selecting the second decoded image data for a pixel, the variation of which exceeds a second threshold, where the second control signal is outputted, and selecting a weighted averaged value of the current-frame image data and the second decoded image data for a pixel, the variation of which is a value between the first and the second thresholds, where the second control signal is outputted.

8. An image display device comprising the image processor recited in claim 1.

9. An image processing method for correcting image data representing a gray-scale value of each of pixels of an image, based on a change in the gray-scale value of each pixel, the image processing method comprising:

a step of dividing a current-frame image into a plurality of blocks using an encoding unit, thereby outputting first encoded image data, corresponding to the current-frame image, the first encoded image data including a representative value denoting a magnitude of pixel data of each of the blocks, and a quantized value obtained by quantizing the pixel data in each of the blocks based on the representative value;

a step of decoding the first encoded image data using a decoding unit, thereby outputting first decoded image data corresponding to the current-frame image;

a step of delaying the first encoded image data for a period equivalent to one frame, thereby outputting second encoded image data corresponding to the image preceding the current frame by one frame;

a step of decoding the second encoded image data, thereby outputting second decoded image data corresponding to the image preceding the current frame by one frame;

a step of calculating variations of the representative value and of the quantized value between the current-frame image and the image preceding by one frame, by referring to the first and the second encoded image data, and determining whether each pixel of the current frame represents a still picture or a motion picture based on the variations of the representative values and the quantized value and generating a control signal which has a first value for a pixel which determined to represent the still picture and has a second value for a pixel which determined to represent the motion picture;

a step of generating one-frame-preceding image data by selecting the current-frame image data or the second decoded image data on a pixel to pixel basis, based on the control signal; and a step of compensating a gray-scale value of the current-frame image, based on the current-frame image data and the one-frame-preceding image data.

10. The image processing method as recited in claim 9, wherein an averaged value of pixel data and a dynamic range of each of the blocks are used as representative values, and variations of the averaged value and the dynamic range are calculated as variations of the representative values.

11. The image processing method as recited in claim 9, wherein, in a block of which change in the representative value is smaller than a predetermined threshold, a first control signal defining a pixel as a still image is outputted for a pixel of which variation of the quantized value is 0 or 1, and a second control signal defining a pixel as a motion image is outputted for a pixel of which variation of the quantized value exceeds 1; and the one-frame-preceding image data is generated by selecting the current-frame image data for a pixel that the first control signal is outputted for, and selecting the second decoded image data for a pixel that the second control signal is outputted for.

12. The image processing method as recited in claim 11, wherein the second control signal defining a pixel as a motion image is outputted for all pixels in a block of which change in the representative value is larger than the predetermined threshold.

13. The image processing method as recited in claim 9, further comprising a step of calculating a variation between the first and the second decoded image data on a pixel to pixel basis, wherein, in a block of which change in the representative value is smaller than a predetermined threshold, a first control signal defining a pixel as a still image is outputted for a pixel of which variation of the quantized value is 0 or 1, and a second control signal defining a pixel as a motion image is outputted for a pixel of which variation of the quantized value exceeds 1; and the one-frame-preceding image data is generated by selecting the current-frame image data for a pixel of which variation is smaller than a predetermined threshold and for a pixel that the first control signal is outputted for, and selecting the second decoded image data for a pixel of which variation exceeds the predetermined threshold and for which the second control signal is outputted.

14. The image processing method as recited in claim 13, wherein the second control signal is outputted for all pixels in a block of which change in the representative value is larger than a predetermined threshold.

15. The image processing method as recited in claim 9, further comprising a step of calculating a variation between the first and the second decoded image data on a pixel to pixel basis, wherein, in a block of which change in the representative value is smaller than a predetermined threshold, a first control signal defining a pixel as a still image is outputted for a pixel of which variation of the quantized value is 0 or 1, and a second control signal defining a pixel as a motion image is outputted for a pixel of which variation of the quantized value exceeds 1; and the one-frame-preceding image data is generated by selecting the current-frame image data for a pixel of which variation is smaller than a first threshold and for a pixel that the first control signal is outputted for, selecting the second decoded image data for a pixel of which variation exceeds a second predetermined threshold and for which the second control signal is outputted, and selecting a weighted averaged value of the current-frame image data and the second decoded image data for a pixel of which variation is between the first and the second thresholds and for which the second control signal is outputted.

16. An image processor that corrects image data representing a gray-scale value of each of pixels of an image, based on a change in the gray-scale value of each pixel, the image processor comprising:

an encoding unit that encodes image data representing a current-frame image thereby outputting the encoded image data corresponding to the current-frame image;

a decoding unit that decodes the encoded image data thereby outputting first decoded image data corresponding to the current-frame image data;

a delay unit that delays the encoded image data for a period equivalent to one frame;

a decoding unit that decodes the encoded image data outputted from said delay unit thereby outputting second decoded image data corresponding to the image data preceding the current frame by one frame;

a calculating unit that calculates a variation between the first and the second decoded image data and an error amount between the current-frame image data and the first decoded image data on a pixel to pixel basis;

a one-frame-preceding-image calculation unit that generates one-frame-preceding image data by selecting current frame image data or the second decoded image data on a pixel to pixel basis based on the variation and the error amount, the one-frame-preceding-image calculation unit determining whether each pixel of the current frame represents a still picture or a motion picture based on the variation and the error amount, the one-frame-preceding-image calculation unit selecting the current frame image data for a pixel determined to present a motion picture and selecting the second decoded image data for a pixel determined to present a still picture; and an image data compensation unit that compensates a gray-scale value of the current-frame image, based on the one-frame-preceding image data and the current-frame image data.

17. The image processor as recited in claim 16, wherein said calculating unit calculates the one-frame-preceding image data by selecting the current-frame image data for a pixel, the variation of which is smaller than a predetermined threshold, and for a pixel, the variation of which is larger than the threshold and equal to two times of the error amount, and selecting the second decoded image data for a pixel, the variation of which is larger than the threshold and not equal to two times of the error amount.

18. The image processor as recited in claim 16, wherein said calculating unit calculates the one-frame-preceding image data by comparing the variation with a first and a second thresholds and comparing an absolute difference value between the variation and two times of the error amount with a third and a forth thresholds, and by selecting the current-frame image data for a pixel, the variation of which is smaller than the first threshold, and for a pixel, the absolute difference value of which is smaller than the third threshold, selecting the second decoded image data for a pixel, the variation of which is larger than the second threshold and the absolute difference value of which is larger than the forth threshold, and selecting a weighted average value of the current-frame image data and the second decoded image data for the other pixels.

19. An image display device comprising the image processor recited in claim 16.

20. An image processing method for correcting image data representing a gray-scale value of each of pixels of an image, based on a change in a gray-scale value of each pixel, the image processing method comprising the steps of encoding image data representing a current-frame image, thereby outputting the encoded image data corresponding to the current-frame image;

decoding the encoded image data, thereby outputting first decoded image data corresponding to the current-frame image data;

delaying the encoded image data for a period equivalent to one frame;

decoding the delayed encoded image data thereby outputting second decoded image data corresponding to the image preceding the current frame by one frame;

calculating a variation between the first and the second decoded image data and an error amount between the current-frame image data and the first decoded image data on a pixel to pixel basis, generating one-frame-preceding image data by selecting the current-frame image data or the second decoded image data on a pixel to pixel basis based on the variations and the error amounts, wherein whether each pixel of the current frame represents a still picture or a motion picture is determined based on the variation and the error amount, and the one-frame-preceding-image is generated by selecting the current frame image data for a pixel determined to present a motion picture and selecting the second decoded image data for a pixel determined to present a still picture; and compensating a gray-scale value of the current-frame image, based on the one-frame-preceding image data and the current-frame image data.

21. The image processing method as recited in claim 20, wherein the one-frame-preceding image data is generated by selecting the current-frame image data for a pixel of which variation is smaller than a predetermined threshold and for a pixel of which variation is larger than the threshold and equal to two times of the error amount, and selecting the second decoded image data for a pixel of which variation is larger than the threshold and not equal to twice of the error amount.

22. The image processing method as recited in claim 20, further comprising:

comparing the variation with a first and a second thresholds, comparing an absolute difference value between the variation and two times of the error amount with a third and a forth thresholds, wherein the one-preceding-frame image data is generated by selecting the current-frame image data for a pixel of which variation is smaller than the first threshold and for a pixel of which absolute difference value is smaller than the third threshold, selecting the second image data for a pixel of which variation is larger than the second threshold and of which absolute difference value is larger than the forth threshold, and selecting a weighted averaged value of the current-frame image data and the second decoded image data for the other pixels.

* * * * *